US005365764A

United States Patent [19]

Kajiwara et al.

[11] Patent Number: 5,365,764

[45] Date of Patent: Nov. 22, 1994

[54] CROSS ROLLING MILL, CROSS ROLLING METHOD AND CROSS ROLLING MILL SYSTEM

[75] Inventors: Toshiyuki Kajiwara, Tokyo; Tsuneo Ochiai; Hidetoshi Nishi, both of Hitachi, all of Japan

[73] Assignee: Hitachi, Ltd., Tokyo, Japan

[21] Appl. No.: 996,093

[22] Filed: Dec. 23, 1992

[30] Foreign Application Priority Data

Dec. 27, 1991 [JP] Japan ..... 3-347031

[51] Int. Cl.[5] ..... B21B 31/20; B21B 1/34

[52] U.S. Cl. ..... 72/229; 72/234; 72/237; 72/241.2; 72/248

[58] Field of Search ..... 72/237, 240, 241.2, 72/241.4, 245, 248, 229, 234

[56] References Cited

U.S. PATENT DOCUMENTS

| | | | |
|---|---|---|---|
| 1,860,931 | 5/1932 | Keller | 72/241.4 |
| 2,762,295 | 9/1956 | Varga et al. . | |
| 4,385,512 | 5/1983 | Matsumoto et al. | 72/199 |
| 4,433,566 | 2/1984 | Tippins et al. | 72/229 |
| 4,453,393 | 6/1984 | Hino et al. . | |
| 4,727,741 | 3/1988 | Ushifusa et al. | 72/241.2 |

FOREIGN PATENT DOCUMENTS

| | | | |
|---|---|---|---|
| 47-27159 | 10/1972 | Japan . | |
| 55-153605 | 11/1980 | Japan . | |
| 56-131004 | 10/1981 | Japan . | |
| 56-131005 | 10/1981 | Japan . | |
| 57-4307 | 1/1982 | Japan . | |
| 0004308 | 1/1982 | Japan | 72/241.2 |
| 57-4315 | 1/1982 | Japan . | |
| 58-304 | 1/1983 | Japan . | |
| 58-157504 | 9/1983 | Japan . | |
| 0087914 | 5/1984 | Japan | 72/237 |
| 59-137104 | 8/1984 | Japan . | |
| 0144503 | 8/1984 | Japan | 72/237 |
| 60-83703 | 5/1985 | Japan . | |
| 62-40916 | 2/1987 | Japan . | |
| 0023842 | 5/1988 | Japan | 72/237 |
| 0150405 | 6/1989 | Japan | 72/241.2 |
| 0055601 | 2/1990 | Japan | 72/237 |
| 4-71701 | 3/1992 | Japan . | |
| 1329848 | 8/1987 | U.S.S.R. . | |

*Primary Examiner*—Lowell A. Larson
*Assistant Examiner*—Thomas C. Schoeffler
*Attorney, Agent, or Firm*—Evenson, McKeown, Edwards & Lenahan

[57] ABSTRACT

In a rolling mill comprising upper and lower work rolls crossed each other to perform strip crown control, a straight line connecting the center of an operation side screwdown screw and the center of a drive side screwdown screw is inclined relative to a line perpendicular to the rolling direction. A cross angle $\theta$ to be controlled is changed in opposite plus and minus directions about the straight line connecting both the screwdown centers. A large extent of strip crown control can be achieved with a smaller cross deviation than usual in the prior art, thereby permitting omission of an equalizer beam. Further, change in the extent by which strip crown is varied upon control with respect to the cross angle becomes substantially linear and hence control is more easily conducted. Since the cross angle $2\theta$ between the two work rolls is larger than 2°, the transition temperature is not changed and uniformity in quality can be ensured.

51 Claims, 18 Drawing Sheets

CROSS ROLLING MILL, CROSS ROLLING METHOD AND CROSS ROLLING MILL SYSTEM

BACKGROUND OF THE INVENTION

The present invention relates to a rolling mill, a rolling method and a rolling mill system for metal strips, and more particularly to a rolling mill with upper and lower rolls and/or upper and lower back-up rolls arranged in crossed relation to each other, a rolling method using such a rolling mill, as well as a rolling mill system including such rolling mills.

As one of strip crown control methods for metal strips, particularly, in hot rolling, there has recently been adopted a scheme of arranging rolls to cross each other. For a 4-high rolling mill, as disclosed in JP, A, 47-27159, the pair cross type that work rolls and back-up rolls are both crossed each other has been practiced for the purpose of avoiding an excessive axial thrust force acting on the work rolls. In this prior art, because the center of a chock for the back-up roll which bears the rolling load is deviated from the center of a screw-down screw or a hydraulic cylinder which serve as a screwdown device, the chock is subjected to twist moment, which causes local load on a sliding face between the chock and a mill housing. Therefore, smoothness of the screwdown operation is diminished and wear of the sliding face is accelerated. To prevent such drawbacks, it has been proposed to balance moment between the drive side and the operation side by, for example, providing an equalizer beam of large rigidity as disclosed in JP, A, 56-131004 and JP, A, 56-131005, or providing a thrust beam as disclosed in JP, A, 57-4307.

It is also known from the description of JP, A, 60-83703, for example, that since the cross arrangement of work rolls causes a metal strip to be deformed in a direction perpendicular to the rolling direction as well, metallurgic quality of the metal strip is improved in some cases.

Meanwhile, a roll cross mill which requires no equalizer beam of large rigidity has been attempted by making only work rolls crossed, other than back-up rolls. This attempt was proposed earlier than the pair cross mill as disclosed in JP, A, 47-27159, for example, but has not succeeded in practical application up to date.

SUMMARY OF THE INVENTION

As explained above, the conventional roll cross mill requires the provision of an equalizer beam of large rigidity or a thrust beam in order to balance twist moment caused due to that the center of a chock for the back-up roll which bears the rolling load is deviated from the center of a screwdown device and, therefore, has a disadvantage of essentially increasing entire size of the mill.

While the fact that the cross arrangement of work rolls may improve metallurgic quality of metal strips in some cases, there is another problem that the metallurgic quality is fluctuated when the cross angle is in a range of about 0° to 1°.

One of the reasons why the above-mentioned mill with only work rolls crossed has not succeeded in practical application is that the problem of roll wear caused by a relative slip between the back-up roll and the work roll could not be solved. More specifically, when only work rolls are crossed, there occurs a relative slip between the back-up roll and the work roll, causing both the back-up roll and the work roll to be worn away.

The work roll suffers from no problem because it must be replaced every two or three hours on account of wear caused by a metal strip much greater than that caused by the aforesaid relative slip. However, the back-up roll is usually replaced with intervals of 10 to 20 days and the replacement requires a lot of time. Thus, the accelerated roll wear entails more frequent replacement of the back-up roll and hence leads to a remarkable reduction in productivity.

On the other hand, when the above-mentioned work roll cross mill is employed in application to hot rolling of non-iron metals or general cold rolling for advantageous use of crown control, there arise problems below.

More specifically, in hot rolling of non-iron metals such as aluminum, for example, aluminum is coated on the surface of the work roll. However, if the intersect angle between the work roll and the back-up roll is large, the coating may peel off or become uneven in thickness distribution, whereby the surface quality of metal strips may vary to a remarkable extent.

Additionally, it is required in general cold rolling to not only make roll wear smaller, but also keep texture of the roll surface as uniform as possible. With the work roll and the back-up roll crossed at a large angle, the roll wear can be held small by virtue of a roll coolant, but roughness of the roll surface may be so abruptly changed as to remarkably vary the surface quality of metal strips. In particular, the reduced surface roughness of the work roll may produce a slip between the roll and the metal strip. Such a slip disables rolling and necessitates earlier replacement of the work roll, thus causing impediment in productivity.

A first object of the present invention is to provide a cross type rolling mill and rolling method by which an equalizer beam can be dispensed with, as well as a rolling mill system using such a rolling mill.

A second object of the present invention is to provide a cross type rolling mill and rolling method by which variations in metallurgic quality due to cross rolling can be held small, as well as a rolling mill system using such a rolling mill.

A third object of the present invention is to provide a 2-high rolling mill and rolling method which contribute to a reduction in the entire system length and have a great crown control capability, as well as a rolling mill system using such a 2-high rolling mill.

A fourth object of the present invention is to provide a 4-high rolling mill and rolling method, the mill carrying out strip crown control with only work rolls changed in a cross angle, which can make wear of back-up rolls smaller and can reduce the frequency of replacement of the back-up rolls, as well as a rolling mill system using such a 4-high rolling mill.

A fifth object of the present invention is to provide a 4-high rolling mill and rolling method, the mill carrying out strip crown control with only work rolls changed in a cross angle, which can make wear of back-up rolls smaller and call reduce change in surface properties and roughness of the work rolls while maintaining a strip crown control function, and hence can suppress variations in the surface quality of metal strips, as well as a rolling mill system using such a 4-high rolling mill.

To achieve the above first and second objects, in accordance with a first aspect of the present invention, there is provided a 2-high rolling mill comprising upper and lower work rolls, and an operation side screwdown device and a drive side screwdown device for applying a screwdown force to at least one of said upper and lower work rolls, said upper and lower work rolls being crossed w/r/t each other to perform strip crown control by changing a cross angle of said upper and lower work rolls, wherein said operation side screwdown device and said drive side screwdown device are arranged such that a straight line connecting the center of said operation side screwdown device and the center of said drive side screwdown device is inclined in the same direction as one said work roll, to which said screwdown force is applied, relative to a line perpendicular to a rolling direction.

Also, to achieve the above first and second objects, in accordance with a second aspect of the present invention, there is provided a 4-high rolling mill comprising upper and lower work rolls, upper and lower back-up rolls, and an operation side screwdown device and a drive side screwdown device for applying a screwdown force to at least one of said upper and lower back-up rolls, at least said upper and lower back-up rolls out of said upper and lower work rolls and said upper and lower back-up rolls being crossed w/r/t each other to perform strip crown control by changing a cross angle of said upper and lower back-up rolls, wherein said operation side screwdown device and said drive side screwdown device are arranged such that a straight line connecting the center of said operation side screwdown device and the center of said drive side screwdown device is inclined in the same direction as one said back-up roll, to which said screwdown force is applied, relative to a line perpendicular to a rolling direction.

To achieve the above first, second, fourth and fifth objects, in accordance with a third aspect of the present invention, there is provided a 4-high rolling mill comprising upper and lower work rolls, upper and lower back-up rolls, and an operation side screwdown device and a drive side screwdown device for applying a screwdown force to at least one of said upper and lower back-up rolls, said upper and lower work rolls being crossed relative to said upper and lower back-up rolls and also crossed w/r/t each other to perform strip crown control by changing a cross angle of said upper and lower work rolls, wherein said upper and lower back-up rolls are arranged such that axes of said upper and lower back-up rolls are each inclined in the same direction as corresponding one of said upper and lower work rolls relative to a line perpendicular to a rolling direction; and said operation side screwdown device and said drive side screwdown device are arranged such that a straight line connecting the center of said operation side screwdown device and the center of said drive side screwdown device is inclined in the same direction and at the same angle as one said back-up roll, to which said screwdown force is applied, relative to the line perpendicular to the rolling direction.

In the rolling mills according to the first to third aspects, preferably, said upper and lower rolls crossed w/r/t each other have each a neutral position for changing said cross angle at the same angular position as the straight line connecting the center of said operation side screwdown device and the center of said drive side screwdown device.

Also, the rolling mill according to the first to third aspects, preferably, further comprises drive means for inclining said upper and lower rolls crossed w/r/t each other in opposite directions about respective angular positions each being the same as the straight line connecting the center of said operation side screwdown device and the center of said drive side screwdown device.

Further, in the rolling mill according to the first to third aspects, preferably, said operation side screwdown device and said drive side screwdown device include each a hydraulic jack and/or a screwdown screw.

To achieve the above first, second and third objects, in accordance with a fourth aspect of the present invention, there is provided a 2-high rolling mill comprising one mill housing, first upper and lower work rolls and second upper and lower work rolls assembled in said mill housing to build up two sets of 2-high cross mills, first drive means for inclining said first and second upper work rolls together, and second drive means for inclining said first and second lower work rolls together, whereby a cross angle of said first and second upper work rolls and a cross angle of said first and second lower work rolls are simultaneously changed by said first and second drive means to perform strip crown control.

In the 2-high rolling mill according to the fourth aspect, preferably, the mill further comprises a first operation side screwdown device and a first drive side screwdown device for applying a screwdown force to at least one of said first upper and lower work rolls, and a second operation side screwdown device and a second drive side screwdown device for applying a screwdown force to at least one of said second upper and lower work rolls, wherein said first operation side screwdown device and said first drive side screwdown device are arranged such that a straight line connecting the center of said first operation side screwdown device and the center of said first drive side screwdown device is inclined in the same direction as one said work roll, to which said screwdown force is applied by said first operation side screwdown device and said first drive side screwdown device, relative to a line perpendicular to a rolling direction, and said second operation side screwdown device and said second drive side screwdown device are arranged such that a straight line connecting the center of said second operation side screwdown device and the center of said second drive side screwdown device is inclined in the same direction as one said work roll, to which said screwdown force is applied by said second operation side screwdown device and said second drive side screwdown device, relative to the line perpendicular to the rolling direction.

Also, in the 2-high rolling mill according to the fourth aspect, preferably, said first and second upper and lower rolls have neutral positions for changing said cross angles, respectively, at the same angular position as the straight line connecting the center of said first operation side screwdown device and the center of said first drive side screwdown device and at the same angular position as the straight line connecting the center of said second operation side screwdown device and the center of said second drive side screwdown device.

Further, in the 2-high rolling mill according to the fourth aspect, preferably, said first and second drive means incline said first upper and lower work rolls and said second upper and lower work rolls in opposite directions, respectively, about respective angular positions each being the same as the straight line connecting the center of said first operation side screwdown device and the center of said first drive side screwdown device and about respective angular positions each being the same as the straight line connecting the center of said second operation side screwdown device and the center of said second drive side screwdown device.

Still further, in the 2-high rolling mill according to the fourth aspect, preferably, the mill further comprises a first upper operation side chock and a first upper drive side chock for supporting said first upper work roll, a first lower operation side chock and a first lower drive side chock for supporting said first lower work roll, a second upper operation side chock and a second upper drive side chock for supporting said second upper work roll, and a second lower operation side chock and a second lower drive side chock for supporting said second lower work roll, wherein said first upper operation side chock and said first lower operation side chock, said first upper drive side chock and said first lower drive side chock, said second upper operation side chock and said second lower operation side chock, and said second upper drive side chock and said second lower drive side chock are arranged to be contacted with each other in pair.

To achieve the above first, second, fourth and fifth objects, in accordance with a fifth aspect of the present invention, there is provided a hot rolling mill system comprising at least one reversible rough rolling mill and a train of finish rolling mills, wherein the rolling mill according to any one of the aspects 1 to 3 is disposed as said reversible rough rolling mill, and the 4-high rolling mill according to the aspect 2 or 3 is disposed as at least one stand in said train of finish rolling mills.

To achieve the above first to fifth objects, in accordance with a sixth aspect of the present invention, there is provided a hot rolling mill system comprising at least one reversible rough rolling mill and a train of finish rolling mills, wherein the rolling mill according to the fourth aspect is disposed as said reversible rough rolling mill, and the 4-high rolling mill according to the aspect 2 or 3 is disposed as at least one stand in said train of finish rolling mills.

To achieve the above first and second objects, in accordance with a seventh aspect of the present invention, there is provided a rolling method of using the 2-high rolling mill according to the first aspect, and controlling said cross angle in opposite plus and minus directions about a neutral position set to be the same angular position as the straight line connecting the center of said operation side screwdown device and the center of said drive side screwdown device.

Also, to achieve the above first and second objects, in accordance with an eighth aspect of the present invention, there is provided a rolling method of using the 4-high rolling mill according to the second aspect, and controlling said cross angle in opposite plus and minus directions about a neutral position set to be the same angular position as the straight line connecting the center of said operation side screwdown device and the center of said drive side screwdown device.

To achieve the above first, second, fourth and fifth objects, in accordance with a ninth aspect of the present invention, there is provided a rolling method of using the 4-high rolling mill according to the third aspect, and controlling said cross angle in opposite plus and minus directions about a neutral position set to be the same angular position as the straight line connecting the center of said operation side screwdown device and the center of said drive side screwdown device.

In the rolling methods according to the aspects 7 to 9, preferably, control of said cross angle is made during the time when no strip is passing through said mill. In the rolling method according to the aspect 9, control of said cross angle may be made during the rolling when a strip is passing through said mill.

Also, in the rolling methods according to the aspects 7 to 9, preferably, said cross angle is made zero relative to the line perpendicular to the rolling direction, when changing said rolls.

To achieve the above first to third objects, in accordance with a tenth aspect of the present invention, there is provided a rolling method of using the 2-high rolling mill according to the fourth aspect, and controlling each of said cross angles in opposite plus and minus directions, respectively, about a neutral position set to be the same angular position as the straight line connecting the center of said first operation side screwdown device and the center of said first drive side screwdown device and about a neutral position set to be the same angular position as the straight line connecting the center of said second operation side screwdown device and the center of said second drive side screwdown device for each of said first upper and lower work rolls and said second upper and lower work rolls in pair.

In the rolling method according to the aspect 10, preferably, control of said cross angle is made during the time when no strip is passing through said mill.

Further, in the rolling method according to the aspect 10, preferably, said cross angle is made zero relative to the line perpendicular to the rolling direction, when changing said rolls.

With the first to tenth aspects of the present invention, the screwdown devices are arranged such that the straight line connecting the center of the operation side screwdown device and the center of the drive side screwdown device is inclined relative to the line perpendicular to the rolling direction, and the cross angle to be controlled is changed in opposite plus and minus directions about the above straight line, whereby a large extent of strip crown control can be achieved with a smaller cross deviation than usual in the prior art and an equalizer beam can be dispensed with. Further, change in the extent by which strip crown is varied upon control with respect to the cross angle becomes substantially linear and hence control is more easily conducted.

As described in JP, A, 60-83703, it is known that the transition temperature is changed depending on the intersect angle $2\eta$ between the upper and lower work rolls in the range of 0° to 0.5° and the range more than 1.0°. However, by changing the cross angle to be controlled in opposite plus and minus directions about the above straight line connecting the center of the operation side screwdown device and the center of the drive side screwdown device, the intersect angle $2\eta$ becomes larger than 2°, with the result of that the transition temperature is not changed and the low temperature toughness is improved. Additionally, the transition temperature has a constant value without variations and uniformity in quality is ensured.

With the fourth, sixth and tenth aspects of the present invention, by assembling two sets of 2-high mills in one housing, the spacing between two rolling points becomes very short and the entire system length can be reduced. By arranging this type rolling mill in such a manner as to simultaneously change the cross angle between the first upper and lower work rolls and the cross angle between the second upper and lower work rolls, the strip crown control capability of a 2-high rolling mill is so increased that the drawback specific to a 2-high rolling mill can be overcome.

With the third, fifth, sixth and ninth aspects of the present invention, in a 4-high rolling mill of the type that a cross angle of only work rolls is changed while holding back-up rolls fixed, the upper and lower back-up rolls are arranged such that their axes can also be inclined. With this arrangement, the angle formed by the work roll and the back-up roll is always held small and, therefore, wear of the back-up rolls becomes so small as to reduce the frequency of replacement of the back-up rolls. Further, a relative slip between the rolls is small and variations in surface properties and roughness of the rolls can be suppressed to an insignificant degree.

DETAILED DESCRIPTION OF THE PREFERRED EMBODIMENTS

The following is a description of several embodiments of the present invention with reference to drawings.

First Embodiment

A first embodiment of the present invention will be described by referring to FIGS. 1 to 8.

Figure 1:
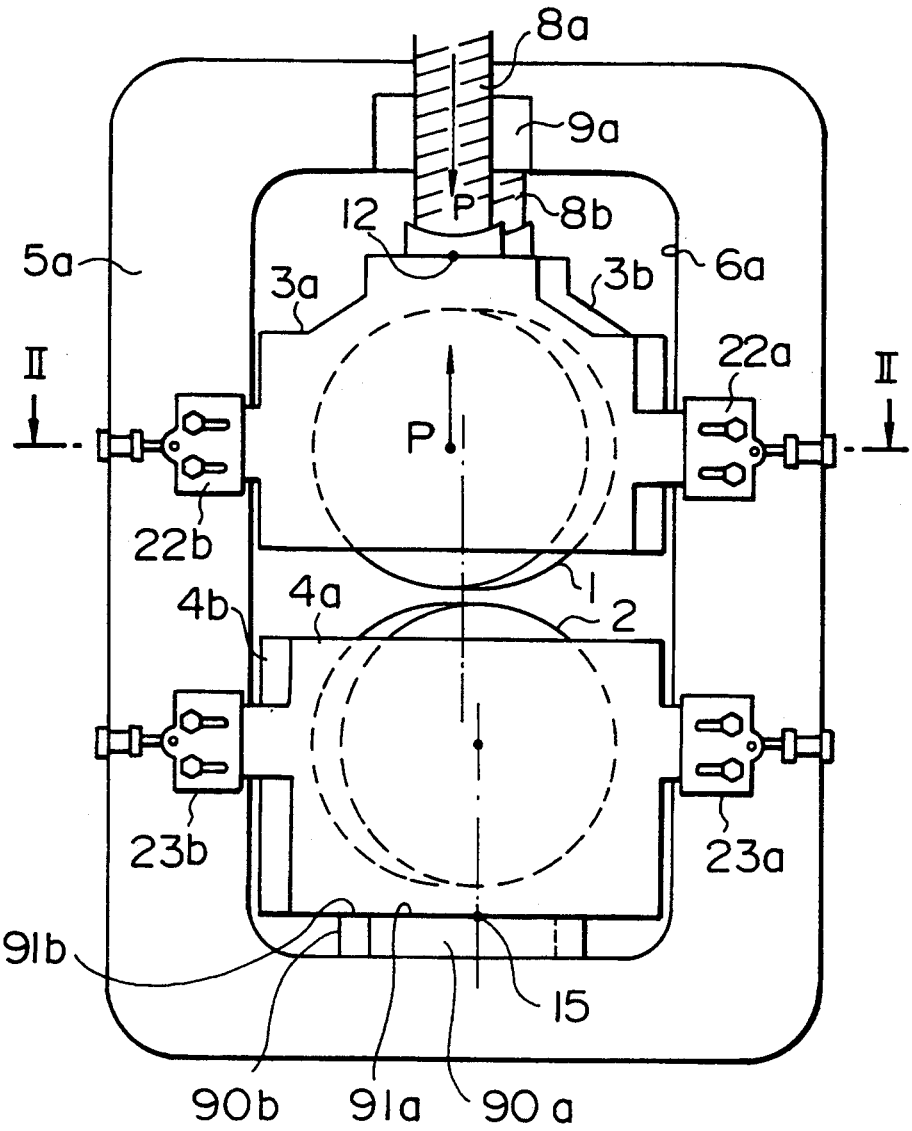
FIG. 1 is a front view of a 2-high rolling mill according to a first embodiment of the present invention.
Figure 2:
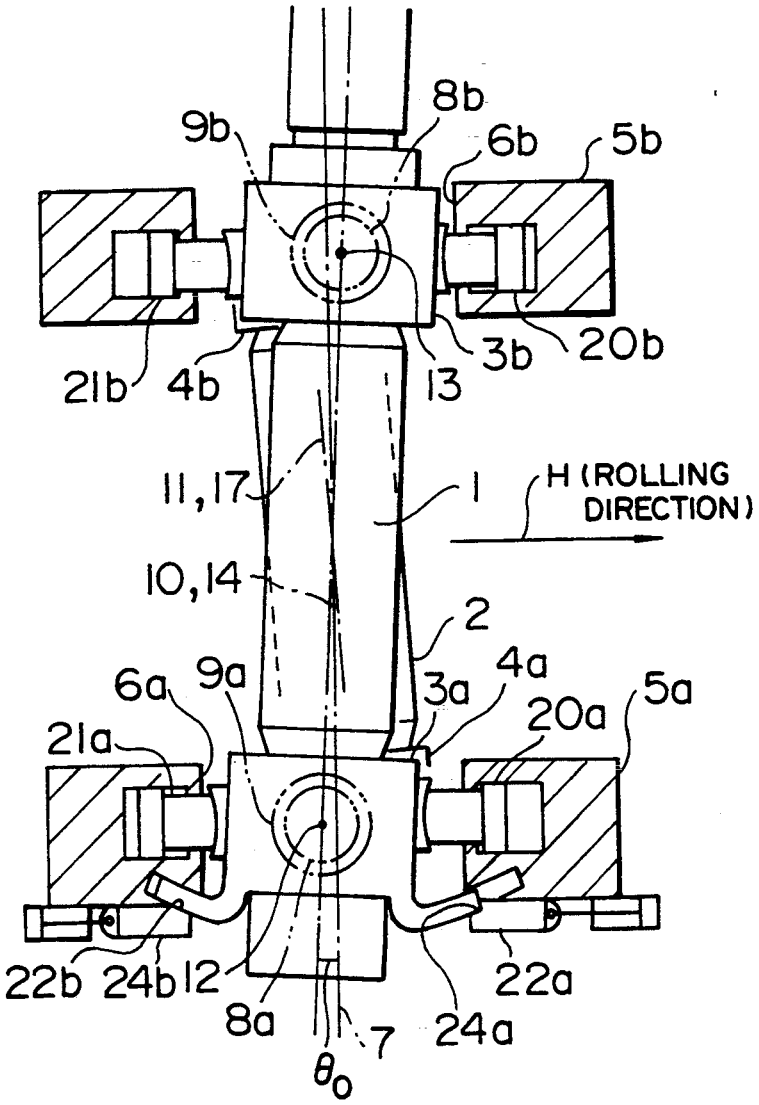
FIG. 2 is a partial sectional view taken along line II—II in FIG. 1.

In FIGS. 1 and 2, a 2-high cross mill of this embodiment comprises upper and lower work rolls 1, 2, and upper chocks 3*a*, 3*b* and lower chocks 4*a*, 4*b* provided at both ends of the work rolls 1, 2 for rotatably supporting the work rolls 1, 2, respectively. The upper chock 3*a* and the lower chock 4*a* are disposed to locate in a window 6*a* of an operation side housing 5*a*, while the upper chock 3*b* and the lower chock 4*b* are disposed to locate in a window 6*b* of a drive side housing 5*b*. The upper work roll 1 and the lower work roll 2 have their axes 10, 11 inclined in opposite directions relative to a line 7 perpendicular to the rolling direction H, so that the upper and lower work rolls 1, 2 are crossed each other. It should be noted that an inclination of the rolls is exaggerated in FIGS. 1 and 2 for clarity of illustration. This equally applies to the subsequent figures.

In upper portions of the operation side and drive side housings 5*a*, 5*b*, there are respectively provided, as screwdown devices, screwdown screws 8*a*, 8*b* and screwdown nuts 9*a*, 9*b* for applying screwdown forces to the upper chocks 3*a*, 3*b*. The screwdown screws 8*a*, 8*b* are arranged such that a straight line 14 connecting their centers 12, 13 is inclined at an angle of 1.2° in the same direction as the upper work roll 1 relative to the line 7 perpendicular to the rolling direction H. In lower portions of the operation side and drive side housings 5*a*, 5*b*, there are respectively provided an operation side support 90*a* and a drive side support 90*b* for supporting the lower chocks 4*a*, 4*b* of the lower work roll 2. The operation side and drive side supports 90*a*, 90*b* are arranged such that a straight line 17 connecting the centers 15, 16 (see FIG. 3) of their chock supporting surfaces 91*a*, 91*b* is inclined at an angle of 1.2° in the same direction as the lower work roll 1 relative to the line 7 perpendicular to the rolling direction H.

In the windows 6*a*, 6*b* of the operation side and drive side housings 5*a*, 5*b*, there are respectively provided two sets of operation side and drive side upper crossing devices which include hydraulic cylinders 20*a*, 21*a* and 20*b*, 21*b* for inclining the upper work roll 1. The angle of the axis 10 of the upper work roll 1 is controlled by driving those upper crossing devices. Likewise, two sets of similar operation side and drive side lower crossing devices (not shown) are provided for the lower work roll 2 so that the angle of the axis 11 of the lower work roll 2 is controlled by driving those lower crossing devices.

Figure 3:
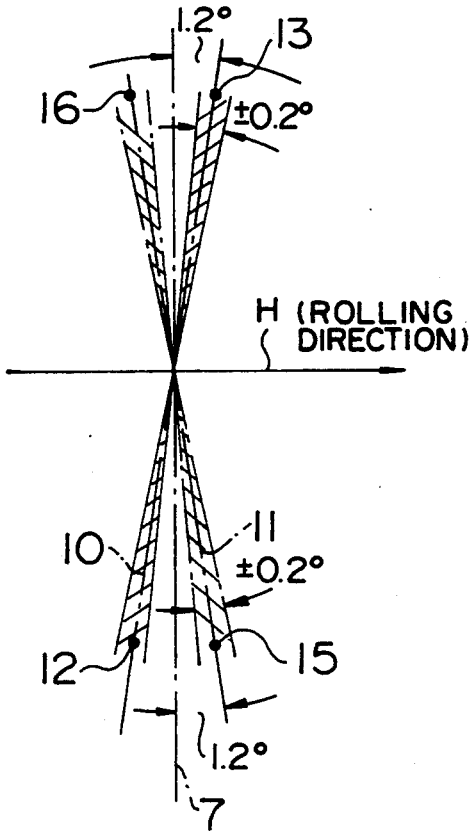
FIG. 3 is an illustration showing a neutral angle of upper and lower work rolls and the control range of a cross angle.

The upper and lower work rolls 1, 2 are inclined by the above-mentioned crossing devices in the range of about ±0.2°, as shown in FIG. 3, in opposite directions about the respective angle of 1.2° relative to the aforesaid perpendicular line 7 for control of a cross angle. More specifically, the angle that the axis 10 of the upper work roll 1 forms relative to the perpendicular line 7 and the angle that the axis 11 of the lower work roll 2 forms relative to the perpendicular line 7 are each defined as a cross angle. Assuming that the cross angle is $\theta$ and the angle corresponding to a neutral position for the cross angle control (i.e., the neutral angle) is $\theta_0$, the cross angle $\theta$ is controlled not in the range of 0 to $\theta_{max}$ as usual in the prior art, but in the range of $\theta_0-\Delta\theta$ to $\theta_0+\Delta\theta$ about the neutral angle $\theta_0$. Since the screwdown force of the screwdown device directly acts on the work roll in the 2-high rolling mill, the cross angle control is performed, as a general rule, during the time when no strip is passing through the mill.

The neutral angle $\theta_0$ for the cross angle control is the same 1.2° as the angle that the straight line 14 connecting the centers 12, 13 of the operation side and drive side screwdown screws 8*a*, 8*b* forms relative to the perpendicular line 7 and the angle that the straight line 17 connecting the centers 15, 16 of the chock supporting surfaces 91*a*, 91*b* of the operation side and drive side supports 90*a*, 90*b* forms relative to the perpendicular line 7. As a result, the centers 12, 13 of the operation side and drive side screwdown screws 8*a*, 8*b* are positioned in vertical alignment with the axis 10 of the upper work roll at the neutral position and also respectively aligned with the centers of the upper chocks 3*a*, 3*b*. Likewise, the centers 15, 16 of the operation side and drive side supports 90*a*, 90*b* are positioned in vertical alignment with the axis 11 of the lower work roll at the neutral position and also respectively aligned with the centers of the lower chocks 4*a*, 4*b*.

In the case of installing hydraulic jacks, instead of the screwdown screws, above the upper chocks 3*a*, 3*b*, the positional relationship of the hydraulic jacks with respect to the chocks 3*a*, 3*b* and the upper work roll 1 is similar to that in the case of using the screwdown screws. Also, when hydraulic jacks or the like for screwdown or adjustment of a pass line level are installed below the lower chocks 4*a*, 4*b*, they are similarly arranged such that a straight line connecting the centers of those operation side and drive side hydraulic jacks are inclined at an angle of 1.2° in the same direction as the lower work roll 2 relative to the line 7 perpendicular to the rolling direction H, whereby the centers of those operation side and drive side hydraulic jacks are positioned in vertical alignment with the axis 11 of the lower work roll 2 at the neutral position and also respectively aligned with the centers of the lower chocks 4*a*, 4*b*.

The upper and lower chocks 3*a*, 4*a* are restricted in the axial direction by keeper plates 22*a*, 22*b* and 23*a*, 23*b* which have arc-shaped surfaces 24*a*, 24*b* for allowing the chocks to incline.

When changing the rolls, the upper and lower work rolls 1, 2 are turned so that their angles of inclination become 0°, i.e., that the cross angle $\theta$ relative to the rolling direction becomes zero, and then drawn out of the housings 5*a*, 5*b* for replacement by new ones. Though not shown, the upper and lower work rolls 1, 2 are each driven by a motor through a universal spindle and a reducer similarly to ordinary rolling mills.

Operating principles of the 2-high rolling mill thus constructed will be described below.

Figure 4:
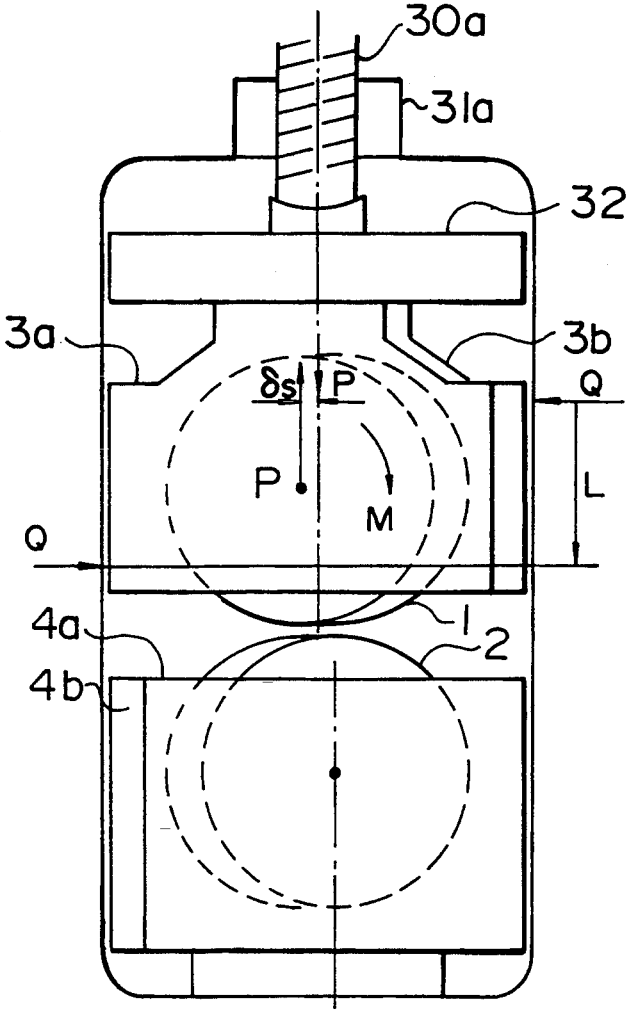
FIG. 4 PRIOR ART
FIG. 4 is a front view of a conventional 2-high rolling mill.

A description will first be given of a conventional 2-high cross mill with reference to FIG. 4. As shown in FIG. 4, the conventional 2-high cross mill comprises upper and lower work rolls 1, 2 of which neutral positions are set such that their axes are perpendicular to the rolling direction. Also, the centers of a screwdown screw 30*a* and a screwdown nut 31*a* are aligned with the centers of chocks of the upper and lower work rolls at their neutral positions.

Figure 5:
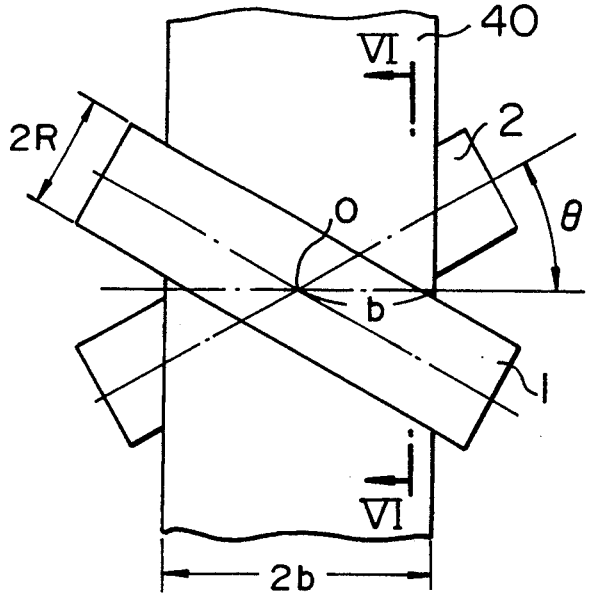
FIG. 5 is an illustration for explaining a roll gap.
Figure 6:
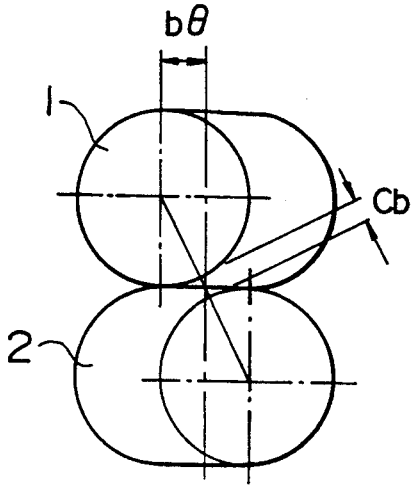
FIG. 6 is an illustration for explaining a roll gap.

In the above conventional 2-high cross mill, when the upper and lower work rolls 1, 2 are turned $\theta$ about the center O of respective roll barrels in opposite directions to cross each other as shown in FIG. 5 and 6, a difference in roll-to-roll gap between the roll center O and an edge of a strip 40 having a width 2*b* spaced from the roll center O by a distance b in the direction of strip width, i.e., a roll gap $C_b$, is approximately expressed below:

$$C_b=(b^2/R)\theta^2 \quad \ldots (1)$$

R: radius of the work roll

Accordingly, a variation $C_{bmax}$ of the roll gap as resulted by changing $\theta$ from zero to $\theta_{max}$ is given by $C_{bmax}=(b^2/R)\theta_{max}^2$.

Further, assuming that the distance between the roll center O and the chock center is d, a displacement of the chock center on the above condition is represented by $\delta_s=d\theta_{max}$ through which the center of the screwdown screw is deviated from the chock center. Thus, the chock is subjected to moment M given below:

$$M=(P/2)\delta_s=d\theta_{max}P/2 \quad \ldots (2)$$

P: rolling load

In a large-sized hot strip mill, by way of example, the following values are resulted:

$$\begin{aligned} P &= 3500\ tf,\ d = 1700\ \text{mm},\ \theta_{max} = 1.2°/57° \\ &= 0.02\ (\text{rad}) \\ M &= 1700 \times 0.02 \times 3500/2 = 60\ tfm \end{aligned}$$

Consequently, the moment M is so large as not negligible. If the moment M acts as it is, abnormal wear would generate between the side face of the chock and the housing surface and increased resistance against the screwdown operation would make it difficult to perform gauge control, because a side force Q is 60 tf even on a condition that the distance Q between acting points of the side force Q on the opposite sides is 1 m as shown in FIG. 4. To eliminate such a drawback, as explained before, an equalizer beam 32 of large rigidity is disposed to span between the drive side and the operation side for canceling out the above moment M in the prior art.

The present invention is to propose a method which requires no equalizer beam, In other words, as explained above, the cross angle $\theta$ is controlled not in the range of 0 to $\theta_{max}$ as usual in the prior art, but in the range of $\theta_0-\Delta\theta$ to $\theta_0+\Delta\theta$ about the neutral angle $\theta_0$ with the center of the screwdown device held in alignment with $\theta_0$.

By so arranging, the crown control range in the prior art is given below;

$$C_1=(b^2/R)\theta_{max}^2 \quad \ldots (3)$$

whereas the crown control range in the present method is given below:

$$C_2=(b^2/R)\{(\theta_0+\Delta\theta)^2-(\theta_0-\Delta\theta)^2\}=(b^2/R)4\theta_0\Delta\theta \quad \ldots (4)$$

On a condition of $C_1=C_2$ so as to present the same effect, the following formula is obtained:

$$4\theta_0\Delta\theta=\theta_{max}^2\Delta\theta=\theta_{max}^2/4\theta_0 \quad \ldots (5)$$

Thus, a condition of $\theta_0=\theta_{max}$ leads to;

$$\Delta\theta=\theta_{max}/4 \quad \ldots (6)$$

whereas a condition of $\theta_0=1.5\ \theta_{max}$ leads to:

$$\Delta\theta=\theta_{max}/6 \quad \ldots (7)$$

This means that the deviation $\Delta\theta_0$ of the cross angle from the neutral position is as small as $\frac{1}{4}$ to 1/6 of the deviation $\theta_{max}$ in the prior art. Correspondingly, the deviation $\delta_s$ of the chock center from the center of the screwdown device is also as small as $\frac{1}{4}$ to 1/6 of the deviation in the prior art and, therefore, the need of providing an equalizer beam is eliminated.

Figure 7:
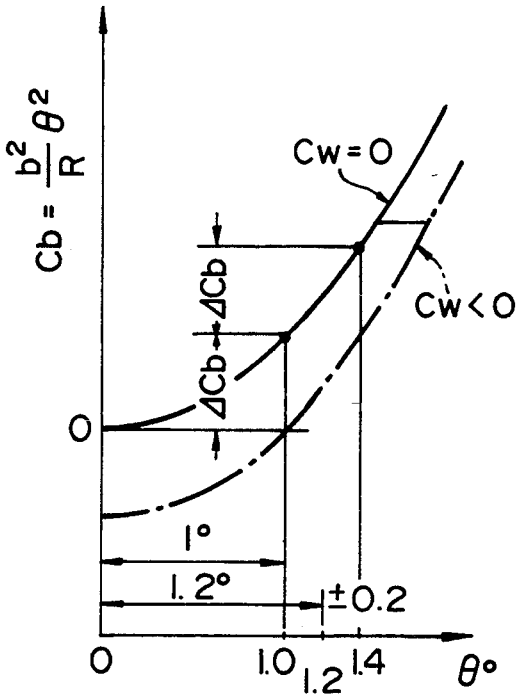
FIG. 7 is a graph showing the relationship of a cross angle $\eta$ of upper and lower work rolls versus a difference $C_b$ in gap between the upper and lower work rolls at a point spaced from the roll center by a distance b in the axial direction.

The above decreasing process of the deviation will now be described in more detail with respect to FIG. 7. FIG. 7 shows how the roll gap crown varies at the point b depending on the cross angle $\theta$. As will be seen, the same extent of control as $\Delta C_b$ obtained in the case of changing the cross angle $\theta$ from zero to $\theta_1$ ($\theta_1=1°$ in FIG. 7) like the prior art can be obtained by change of $\pm0.2°$ in the case of $\theta_0=1.2°$. Thus, the extent of control is reduced from 1° down to 2/5, i.e., 0.4°, and the deviation from the neutral angle is reduced from 1° down to 1/5, i.e., 0.2°. However, if an absolute value of the roll gap $C_b$ is too large, the work roll is required to have small initial crown $C_w$ or, in some cases, concave crown ($C_w<0$).

As explained above, with this embodiment arranged such that the upper work roll 1 is crossed $\pm0.2°$ with respect to a reference line given by the axis 10 thereof at the neutral angle and the lower work roll 2 is crossed $\pm0.2°$ with respect to a reference line given by the axis 11 thereof at the neutral angle oppositely to the cross direction of the upper work roll, the deviation of the chock center from the center of the screwdown device caused by the cross angle can be reduced from 1° in the prior art down to 1/5, i.e., 0.2°. The side force Q produced between the chocks 3*a*, 3*b* and 4*a*, 4*b* and the mill housings 5*a*, 5*b* is also naturally reduced down to 1/5, i.e., 12 tf, of the value in the prior art so that no actual impediment is caused in practical use. As a result, an equalizer beam can be dispensed with.

Further, while the extent by which strip crown is varied upon control was proportional to the square of the cross angle in the prior art, it is substantially linear in the range of 1.0° to 1.4° for the angle $\theta$ in FIG. 7 according to this embodiment, which presents another advantage of making control easier.

Figure 8:
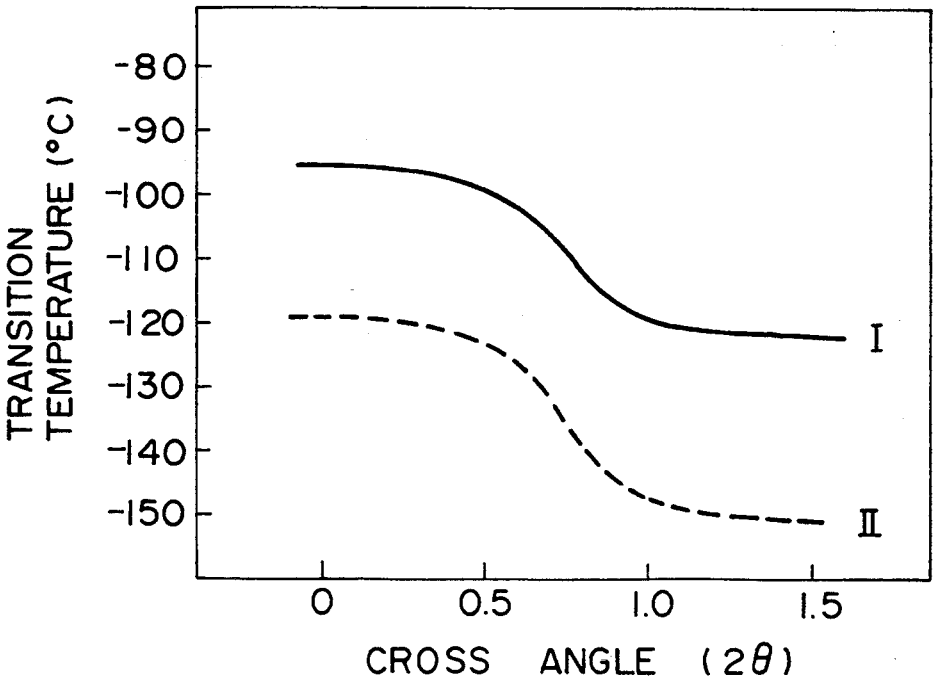
FIG. 8 is a graph showing the relationship between an intersect angle $2\eta$ and transition temperature.

Additionally, FIG. 8 is a graph cited from JP, A, 60-83703 in which the horizontal axis represents an intersect angle between upper and lower work rolls which is twice the cross angle $\theta$ defined in this specification. In the case of hot rolling of iron, as will be seen from the graph, the transition temperature is changed depending on the intersect angle $2\theta$ between the upper and lower work rolls in the range of 0° to 0.5° and the range more than 1.0° under two different types of hot rolling conditions I, II. Accordingly, if the cross angle $\theta$ is controlled in the range of 0° to 1° as with the prior art, the intersect angle $2\theta$ ranges from 0° to 2°. Because the transition temperature is changed when the intersect cross $2\theta$ is controlled in the range of 0.5° to 1.0°, the metallurgical quality of strips is varied. On the contrary, in this embodiment, since the intersect angle $2\theta$ is larger than 2° as explained above, the transition temperature is not changed and hence the low temperature toughness is improved. In addition, the transition temperature has a constant value without variations, thus ensuring uniform quality.

As described above, this embodiment makes it possible to perform a large extent of strip crown control with a smaller cross deviation than usual in the prior art, eliminate the need of an equalizer beam, and achieve a smaller-sized rolling mill with simple construction. It is also possible to keep uniform the effect resulted from cross rolling upon the metallurgical structure of strips to be rolled. Moreover, the extent by which strip crown is varied upon control becomes substantially linear rather than being proportional to the square of the cross angle, with the advantage of making control easier.

Second Embodiment

A second embodiment of the present invention will be described by referring to FIGS. 9 to 11. In this embodiment, the present invention is applied to a 2-high cross mill in the form of a 2-high twin mill.

Figure 9:
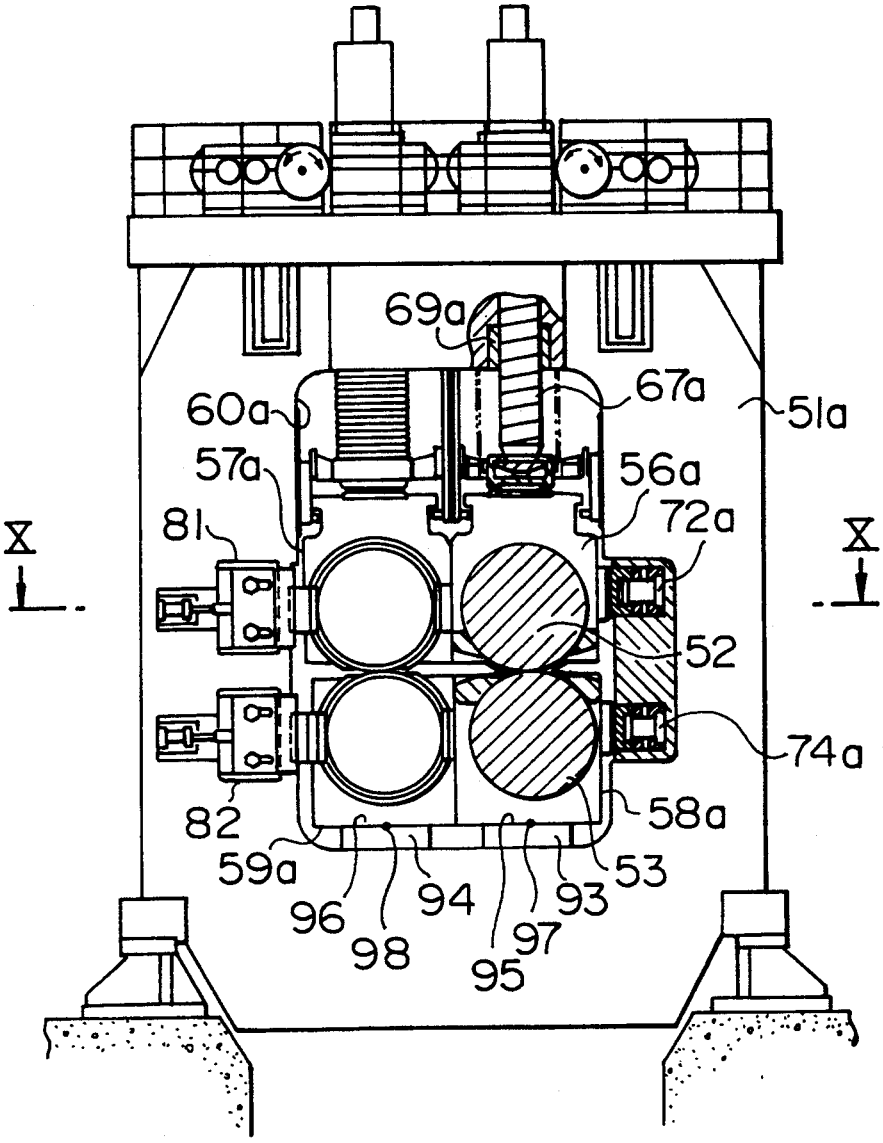
FIG. 9 is a front view, partly in section, of a 2-high rolling mill (twin mill) according to a second embodiment of the present invention.
Figure 10:
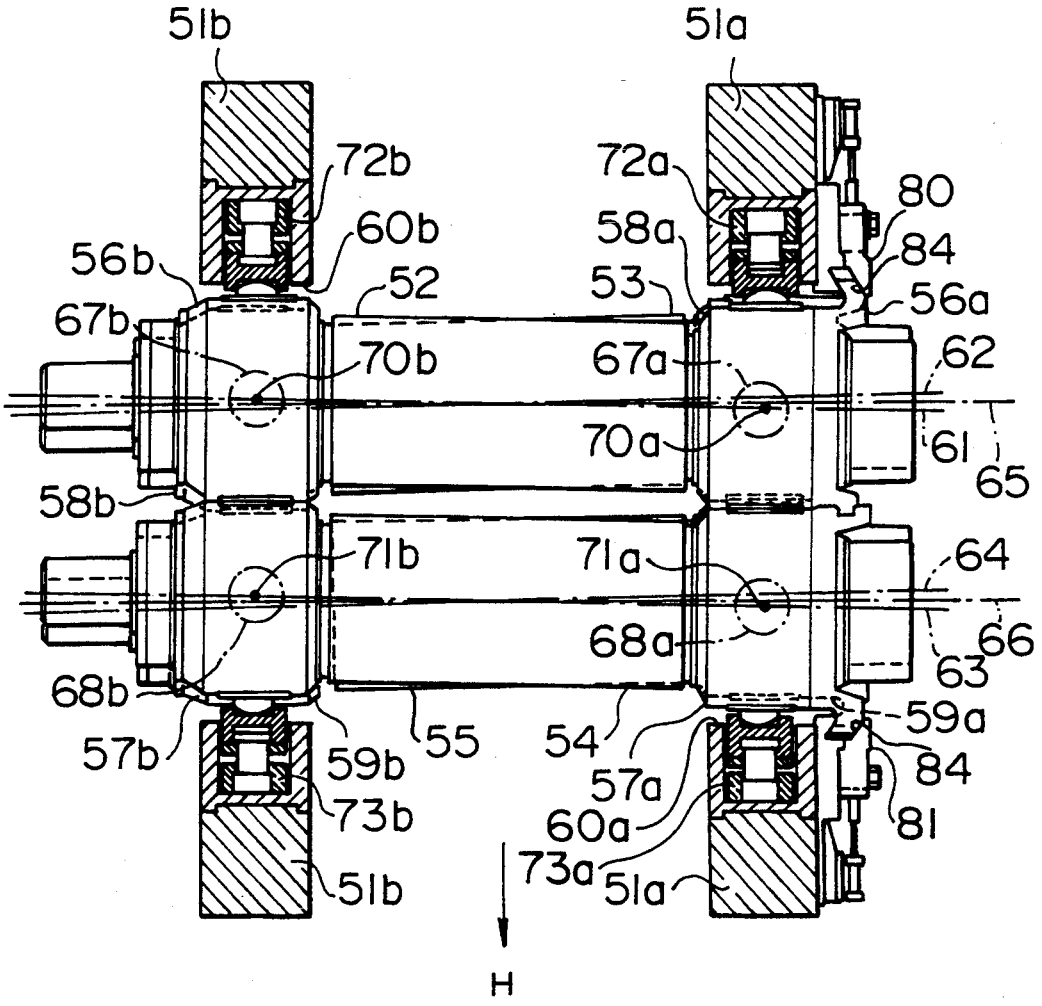
FIG. 10 is a partial sectional view taken along line X—X in FIG. 9.

In FIGS. 9 and 10, a mill of this embodiment comprises operation side and drive side mill housings 51*a*, 51*b*, first upper and lower work rolls 52, 53 and second upper and lower work rolls 54, 55 which are assembled to the mill housings 51*a*, 51*b*, first upper chocks 56*a*, 56*b* for supporting the first upper roll 52 and first lower chocks 58*a*, 58*b* for supporting the first lower work roll 53, as well as second upper chocks 57*a*, 57*b* for supporting the second upper roll 54 and second lower chocks 59*a*, 59*b* for supporting the second lower work roll 55. In other words, the mill of this embodiment comprises two sets of upper work rolls 52, 54 and upper chocks 56*a*, 56*b*, 57*a*, 57*b*, and two sets of lower work rolls 53, 55 and lower chocks 58*a*, 58*b*, 59*a*, 59*b*. The upper chocks 56*a*, 57*a* and the lower chocks 58*a*, 59*a* are disposed to locate in a window 60*a* of the operation side housing 51*a*, while the upper chocks 56*b*, 57*b* and the lower chock 58*b*, 59*b* are disposed to locate in a window 60*b* of the drive side housing 51*b*. Thus, two sets of 2-high mills are assembled in the common mill housings 51*a*, 51*b*. The mill thus constructed will be abbreviated as "a twin mill" in this specification.

The upper work rolls 52, 54 and the lower work rolls 53, 55 have their axes 61, 63 and 62, 64 inclined in opposite directions relative to lines 65, 66 perpendicular to the rolling direction H, so that the upper and lower work rolls are crossed each other.

In upper portions of the operation side and drive side housings 51*a*, 51*b*, there are provided, as screwdown devices, screwdown screws 67*a*, 67*b*, 68*a*, 68*b* and screwdown nuts 69*a* (only one of which is shown in FIG. 9) for applying screwdown forces to the upper chocks 56*a*, 57*a* and 56*b*, 57*b*. Similarly to the first embodiment, those screwdown screws are arranged such that straight lines 61, 63 connecting their centers 70*a*, 70*b* and 71*a*, 71*b* are inclined at an angle of 1.2° in the same direction as the upper work rolls 52, 54 relative to the lines 65, 66 perpendicular to the rolling direction H. In lower portions of the operation side and drive side housings 51*a*, 51*b*, there are provided operation side and drive side supports 93, 94 (only the operation side supports being shown) for supporting the lower chocks 58*a*, 58*b*, 59*a*, 59*b*. The operation side and drive side supports 93, 94 are arranged similarly to the first embodiment such that straight lines 62, 64 connecting the centers 97, 98 of their chock supporting surfaces 95, 96 (only the operation side being shown) are inclined at an angle of 1.2° in the same direction as the lower work rolls 53, 55 relative to the lines 65, 66 perpendicular to the rolling direction H.

In the windows 60*a*, 60*b* of the operation side and drive side housings 51*a*, 51*b*, there are provided upper crossing devices which include hydraulic cylinders 72*a*, 73*a*, 72*b*, 73*b* for driving the upper chocks 56*a*, 56*b*, 57*a*, 57*b*. Likewise, similar lower crossing devices including hydraulic cylinders 74*a* (only one of which is shown) are provided for the lower chocks. The upper crossing devices jointly constitute first drive means for inclining the upper work rolls 52, 54 together, while the lower crossing devices jointly constitute second drive means for inclining the lower work rolls 53, 55 together. The cross angle of the first upper and lower work roll 52, 53 and the cross angle of the second upper and lower work rolls 54, 55 are thereby controlled so as to change at the same time.

The crossing devices are required to be provided one set for each of the entry and exit sides of the rolls, that is, four sets in total at the upper and lower sides for each of the operation side and the drive side. These crossing devices may be arranged in two ways; all the crossing devices are of the position control type, or one crossing device in each set on the operation side and the drive side is of the position control type and the remaining is of the pressure control type. The latter arrangement is superior in easily canceling out clearances between the chocks and the crossing devices. The following description will be given of an example of the latter case with reference to FIG. 11.

Figure 11:
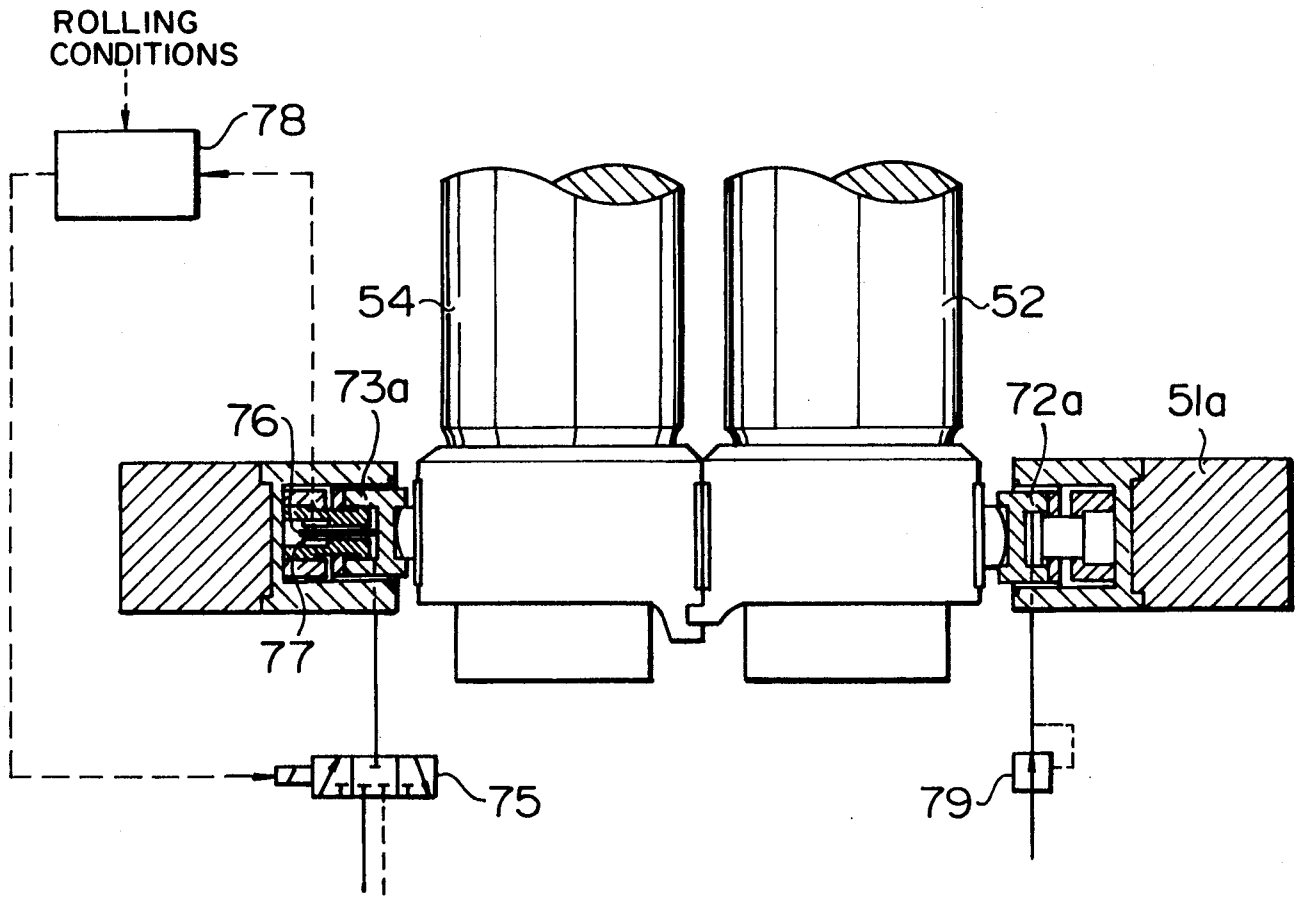
FIG. 11 is a diagram showing a hydraulic control system for crossing devices.

A hydraulic fluid is supplied, as shown in FIG. 11, via a solenoid valve 75 to the hydraulic cylinders 73*a*, 72*b* for the upper chocks 56*b*, 57*a*. The amount through which rams of the hydraulic cylinders 73*a*, 72*b* has moved is detected by a sensor 77 for detecting a displacement of a rod 76 attached to the ram. The solenoid valve 75 is driven by a control signal from a controller 78. The controller 78 calculates the target amount of movement of the rams in response to a command signal depending on rolling conditions, compares the calculated target value with a detection signal of the sensor 77 fed back thereto, and then performs position control so that the amount of movement of the rams is held in match with the target value. On the other hand, supplied to the hydraulic cylinders 72*a*, 73*b* for the upper chocks 56*a*, 57*b* is a hydraulic fluid via a reducing valve 79 to perform pressure control so that these chocks are urged under a predetermined pressure. The hydraulic cylinders for the lower chocks are driven in a similar combination of position control and pressure control. By so operating one cylinder in each set of crossing devices on the operation side and the drive side with position control and the other cylinder in each set with pressure control, the precise cross angle control can be performed without causing clearances between the chocks and the hydraulic cylinders.

The upper and lower work rolls 52, 53 and 54, 55 are inclined by the above-mentioned crossing devices, similarly to the first embodiment, in the range of about ±0.2° in opposite directions about the respective cross angle of 1.2°. More specifically, also in this embodiment, a neutral angle $\theta_0$ for the cross angle control is the same 1.2° as the angle that the straight lines 61, 63 connecting the centers 70*a*, 70*b* and 71*a*, 71*b* of the operation side and drive side screwdown screws 67*a*, 67*b* and 68*a*, 68*b* form relative to the aforesaid perpendicular lines 65, 66 and the angle that the straight lines 62, 64 connecting the centers 97, 98 of the chock supporting surfaces 95, 96 (only the operation side being shown) of the operation side and drive side supports 93, 94 form relative to the aforesaid perpendicular lines 65, 66. In this embodiment, too, since the screwdown force of the screwdown device directly acts on the work roll, the cross angle control is performed, as a general rule, during the time when no strip is passing through the mill.

Adjacent twos of the upper chocks 56*a*, 56*b*, 57*a*, 57*b* are mutually restricted in relative movement in the axial direction. Likewise, adjacent twos of the lower chocks 58*a*, 58*b*, 59*a*, 59*b* are mutually restricted in relative movement in the axial direction. Therefore, the center about which the work rolls are turned for changing the cross angle is given by a point in alignment with the center of the rolling pass and also with the middle between both the work rolls 52 and 54 or 53 and 55. It should be noted that if the adjacent chocks are allowed to move relatively to each other, the turning center of the work rolls is separated to the centers of the respective roll barrel lengths. This alternative arrangement can avoid the disadvantage that the axial center position of the roll is axially displaced upon the cross angle being changed.

Generally, a roll chock is subjected to an axial thrust force as well as rolling load. It is known that when work rolls are crossed each other relative to a line perpendicular to the rolling direction, there produces a thrust force in amount of 2 to 5% of the rolling load. To bear such a thrust force at the chock center, the chock is usually supported by keeper plates at two locations spaced from the chock center perpendicularly to the roll axis. In this embodiment, however, since the adjacent chocks are held in contact with each other, it is difficult to provide two keeper plates per chock. Therefore, keeper plates 80, 81, 82 (the remaining one being not shown) are provided at respective one sides of the four chocks in the upper and lower sides so as to bear the thrust forces. These keeper plates have arc-shaped surfaces 83, 84 (only the operation side surfaces being shown) for allowing the chocks to incline. Even though the keeper plates are arranged to bear the thrust forces only at one sides of the chocks as mentioned above, the thrust forces are normally applied to the chocks by mutually restricting the adjacent chocks such that they will not incline relative to the roll axis.

Furthermore, if the neutral angle $\theta_0$ of the crossed rolls is designed to keep $\theta_0 \pm \Delta\theta$ always positive in this embodiment, the direction of the thrust force is uniquely determined in a certain direction at all times. In the case where the chock is a combination of a radial bearing and a thrust bearing, it is therefore possible to adopt such a combination only for the chock on one side and construct the chock on the other side by a radial bearing. Needless to say, the thrust forces act on the upper and lower rolls in opposite directions.

When changing the rolls, the upper and lower rolls are turned similarly to the first embodiment so that their angles of inclination become 0°, i.e., that the cross angle $\theta$ relative to the rolling direction becomes zero, following which the two sets of upper and lower rolls and chocks are simultaneously drawn out of the housings 51*a*, 51*b* for replacement by new ones. Though not shown, the upper and lower rolls are each driven by a motor through a universal spindle and a reducer as with ordinary rolling mills.

As explained above, this embodiment represents an application example of modifying a 2-high twin mill into the cross type and its operating effect will be described below.

In a twin mill comprising two sets of 2-high rolling mills incorporated in a single mill housing, the distance between two rolling points is very short. Accordingly, application such a twin mill to a rough rolling mill in a hot rolling mill system gives rise to great advantages in terms of equipment and operation, such as a reduction in the system length, a saving in energy due to omission of one path of high pressure water descaling, prevention of a temperature drop of strips, and omission of inter-stand sideguides. However, the simple 2-high twin mill has one drawback of change in the strip crown by a deflection of the work roll. Considering, particularly, the application to a rough rolling mill for aluminum, since flow stress is different on the order of several times or more between pure aluminum and aluminum alloy, the rolling load is so much different therebetween as to change an appropriate crown of the work roll to a large extent. Although this problem is alleviated by adopting a 4-high rolling mill, a twin mill comprising two sets of 4-high rolling mills is too large and complex to realize practical use. Consequently, it is required to increase the crown control capability while using 2-high rolling mills.

With this embodiment, the cross rolling is effected by a 2-high twin mill to enhance the crown control capability, as mentioned above, whereby the drawback of the simple 2-high twin mill can be solved. Also, providing some unit between the roll chocks is disadvantageous not only in lengthening the distance between two rolling points, but also on an economical basis because additional crossing devices must be mounted between the intervening unit and the work roll. With this embodiment arranged such that the upper and lower chocks of the work rolls are held in contact with each other on either side, only one set of crossing devices is required for the adjacent two chocks and the spacing between two rolling points is further reduced to enable an even shorter system length.

Third to Fifth Embodiments

Figure 12:
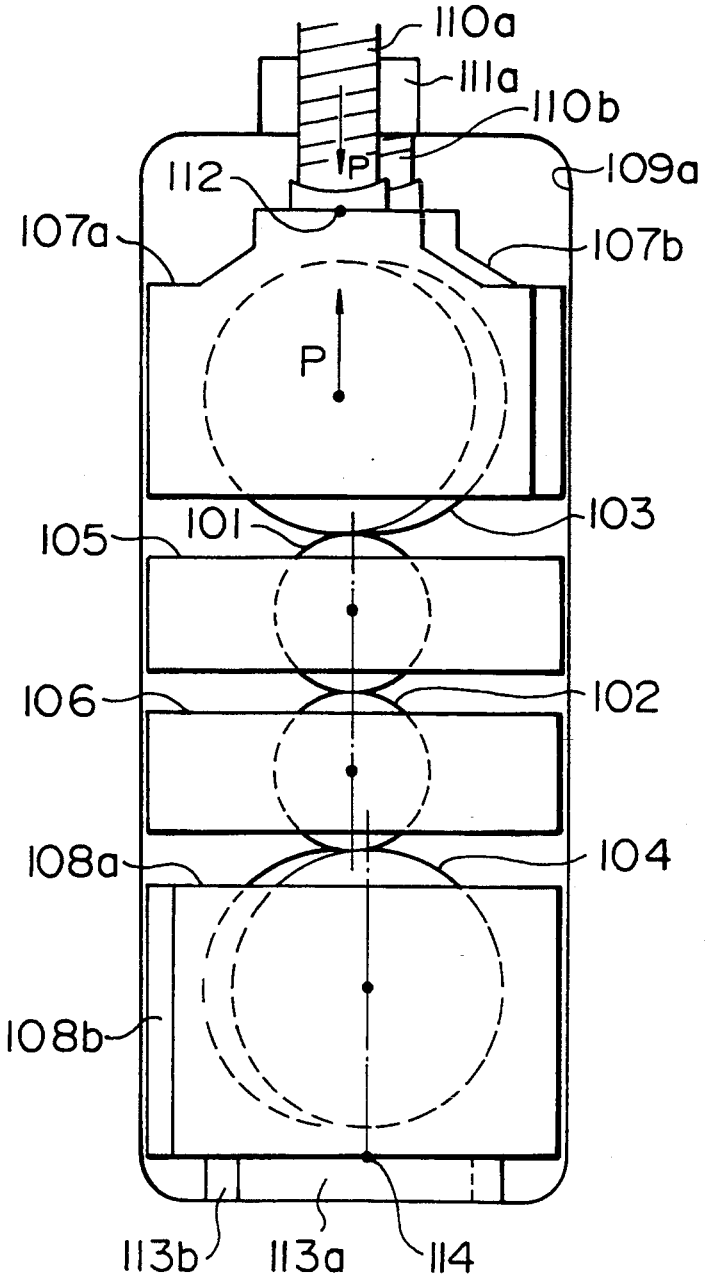
FIG. 12 is a front view of a 4-high back-up roll cross mill according to a third embodiment of the present invention.

Still other embodiments of the present invention will be described by referring to FIGS. 12 to 14. FIG. 12 shows a 4-high back-up roll cross mill according to a third embodiment of the present invention, FIG. 13 shows a 4-high pair cross mill according to a fourth embodiment of the present invention, and FIG. 14 shows a 4-high back-up roll cross mill according to a fifth embodiment of the present invention.

In FIG. 12, the 4-high back-up roll cross mill comprises upper and lower work rolls 101, 102, upper and lower back-up rolls 103, 104 for respectively supporting the upper and lower work rolls, upper chocks 105 (only the operation side chock being shown) and lower chocks 106 (only the operation side chock being shown) provided at both ends of the work rolls for rotatably supporting the work rolls, as well as upper chocks 107*a*, 107*b* and lower chocks 108*a*, 108*b* provided at both ends of the back-up rolls for rotatably supporting the back-up rolls. Similarly to the work rolls in the first embodiment, the upper and lower back-up rolls 103, 104 have their axes inclined in opposite directions relative to a line perpendicular to the rolling direction, so that the upper and lower back-up rolls 103, 104 are crossed w/r/t each other.

In upper portions of an operation side housing 109*a* and a drive side housing (not shown), there are respectively provided, as screwdown devices, screwdown screws 110*a*, 110*b* and screwdown nuts 111*a* (the drive side nut being not shown). The screwdown screws 110*a*, 110*b* are arranged such that a straight line connecting their centers 112 (only the operation side center being shown) is inclined at an angle of 1.2° in the same direction as the upper back-up roll 103 relative to the line perpendicular to the rolling direction. Operation side and drive side supports 113*a*, 113*b* for respectively supporting the lower chocks 108*a*, 108*b* of the lower back-up roll 104 are likewise arranged such that a straight line connecting the centers 114 (only the operation side center being shown) of their chock supporting surfaces is inclined at an angle of 1.2° in the same direction as the lower back-up roll 104 relative to the line perpendicular to the rolling direction. The upper and lower back-up rolls 103, 104 are inclined by crossing devices acting on their chocks 107*a*, 107*b* and 108*a*, 108*b* in the range of about ±0.2° in opposite directions about the respective neutral angle of 1.2° for control of the cross angle. Though not shown, the upper and lower chocks 107*a*, 107*b* and 108*a*, 108*b* are axially restricted by keeper plates.

Figure 13:
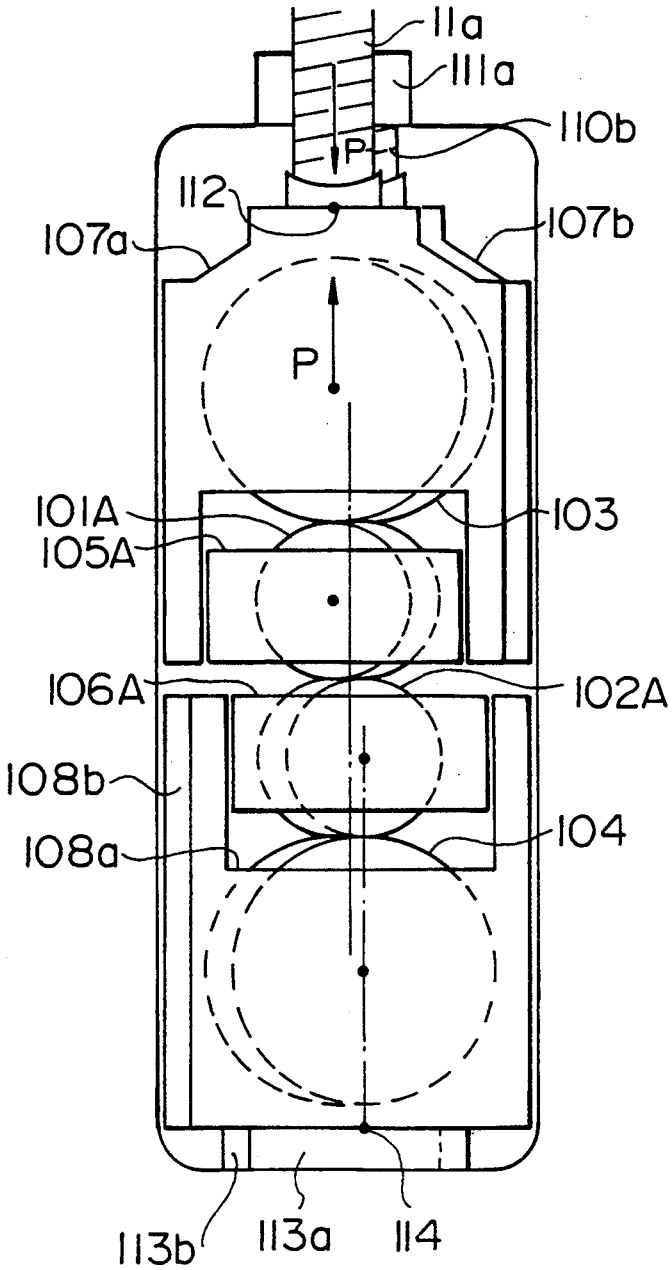
FIG. 13 is a front view of a 4-high pair cross mill according to a fourth embodiment of the present invention.
Figure 14:
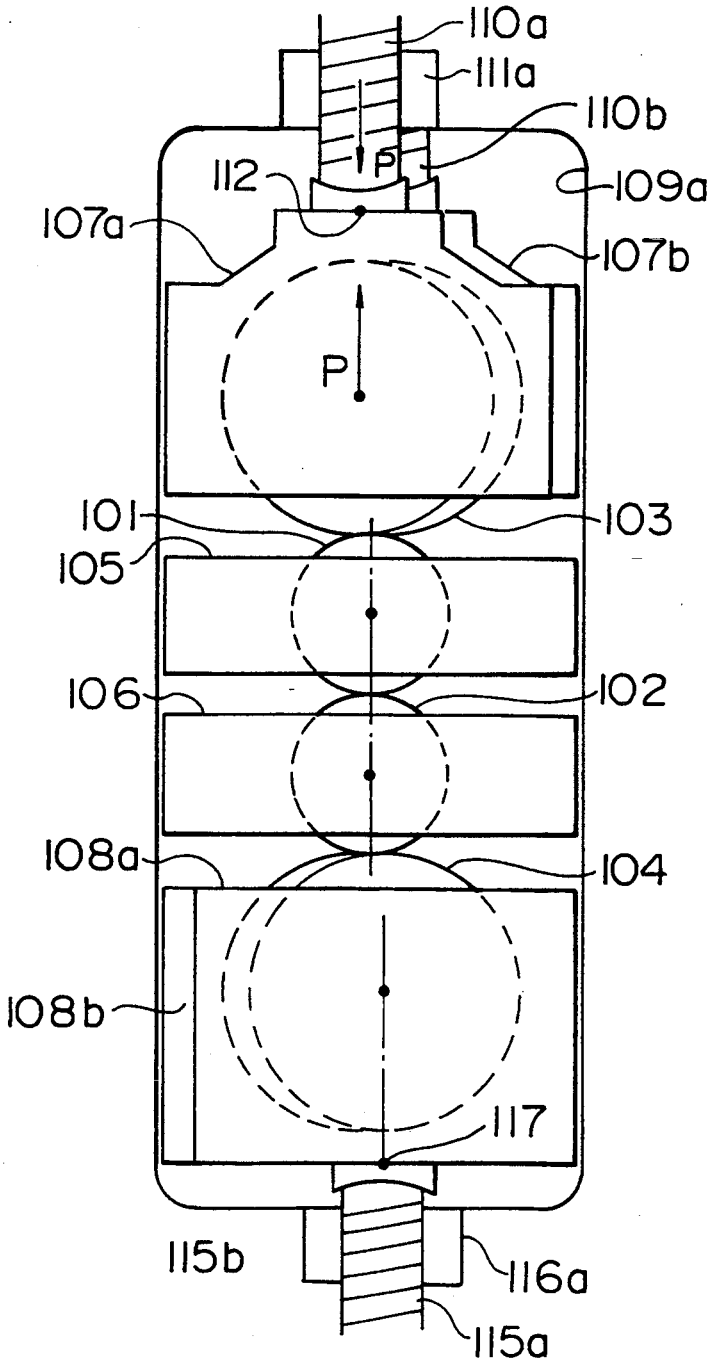
FIG. 14 is a front view of a 4-high back-up roll cross mill according to a fifth embodiment of the present invention.

In the 4-high pair cross mill shown in FIG. 13, the axes of the upper and lower work rolls 101A, 102A are also inclined, along with the axes of the upper and lower back-up rolls 103, 104, in opposite directions relative to the line perpendicular to the rolling direction, so that the upper and lower work rolls 101A, 102A and the upper and lower back-up rolls 103, 104 are crossed each other in pair. The upper and lower work rolls 101A, 102A and the upper and lower back-up rolls 103, 104 are inclined by crossing devices acting on their chocks in the range of about ±0.2° in opposite directions about the respective neutral angle of 1.2° for control of the cross angle. The other construction is the same as that of the embodiment shown in FIG. 12.

In the 4-high back-up roll cross mill shown in FIG. 14, screwdown screws 115*a*, 115*b* and screwdown nuts 116*a* (the drive side nut being not shown) for adjusting a pass line level are respectively provided in the lower portions of the operation side housing 109*a* and the drive side housing (not shown). The screwdown screws 116*a*, 116*b* are arranged such that a straight line connecting their centers 117 (only the operation side center being shown) is inclined at an angle of 1.2° in the same direction as the lower back-up roll 104 relative to the line perpendicular to the rolling direction. The other construction is the same as that of the embodiment shown in FIG. 12.

Thus, FIG. 12 represents the embodiment in which only the upper and lower back-up rolls are crossed each other in a 4-high rolling mill, and FIG. 13 represents the embodiment in which the upper work and back-up rolls and the lower work and back-up rolls are crossed each other in a 4-high rolling mill. It is apparent that in the case of FIG. 12, the roll gap between the back-up roll and the work roll corresponds to the above-mentioned difference $C_b$ in gap between the upper and lower rolls and, therefore, the similar effect to that in the above embodiments can be developed on strips through the work roll. In either case, the centers of the operation side and drive side screwdown screws 110*a* are aligned with the axis of the upper back-up roll at its neutral position or with the centers of the operation side and drive side chocks of the upper back-up roll at its neutral position.

Further, FIG. 14 represents the case where additional screwdown screws are provided below the lower chocks in the 4-high back-up roll cross mill of FIG. 12. As with the screwdown screws 110*a*, 110*b*, the centers of the screwdown screws 115*a*, 115*b* are aligned with the centers of the lower chocks 108*a*, 108*b* of the lower back-up roll at its neutral position.

As with the foregoing embodiments, the rolls are inclined by crossing devices through the above-mentioned mechanisms, and the rolls are changed by the method of turning the rolls to make an angle of inclination 0°, drawing out the rolls, and replacing them by new ones.

In the third to fifth embodiments, too, since the screwdown force of the screwdown device directly acts on the work roll to be inclined, the cross angle control is performed, as a general rule, during the time when no strip is passing through the mill.

These embodiments can also present the similar operating effect in a 4-high rolling mill to that in the first embodiment.

Sixth Embodiment

A sixth embodiment of the present invention will be described by referring to FIGS. 15 to 17.

Figure 15:
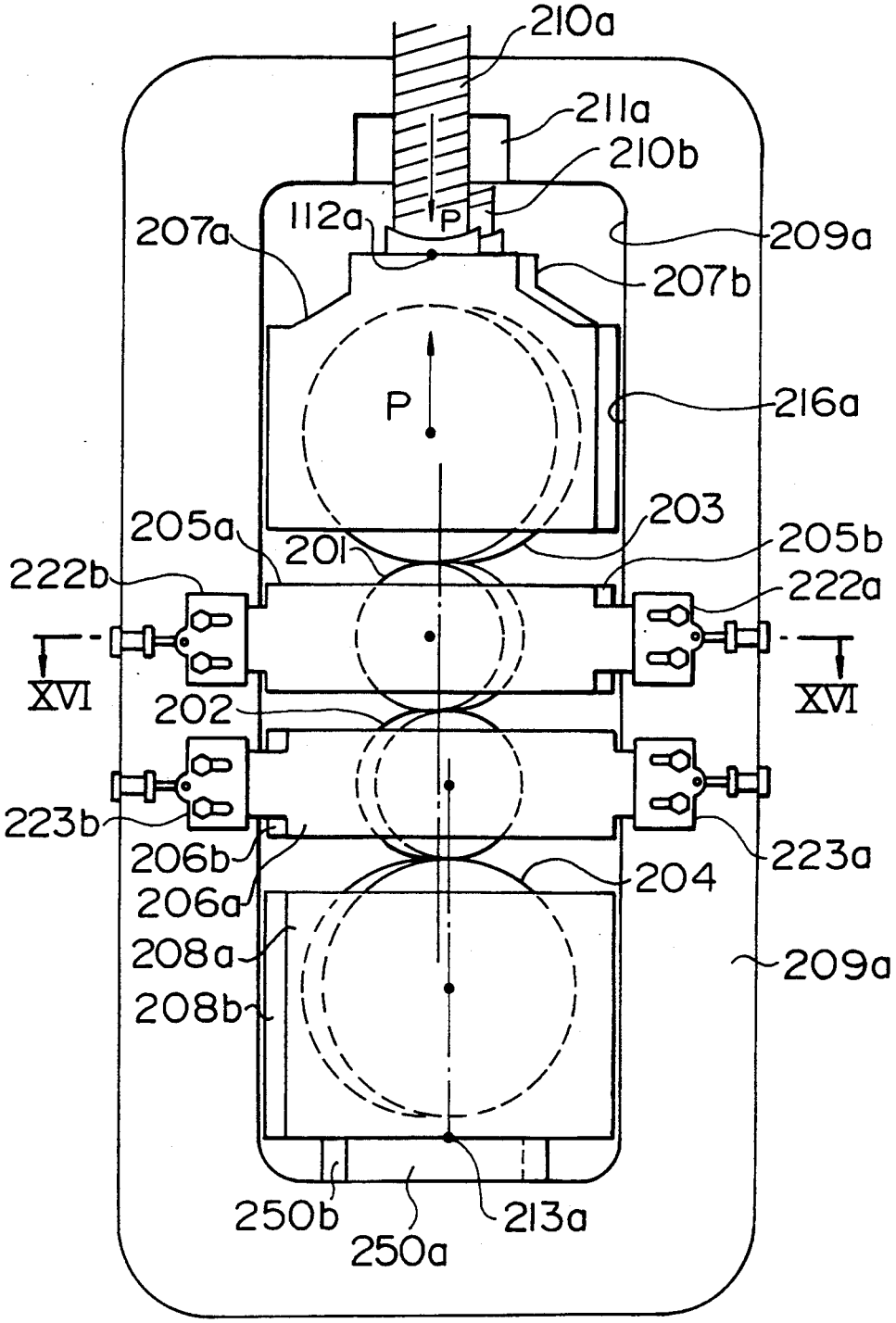
FIG. 15 is a front view of a 4-high rolling mill according to a sixth embodiment of the present invention.
Figure 16:
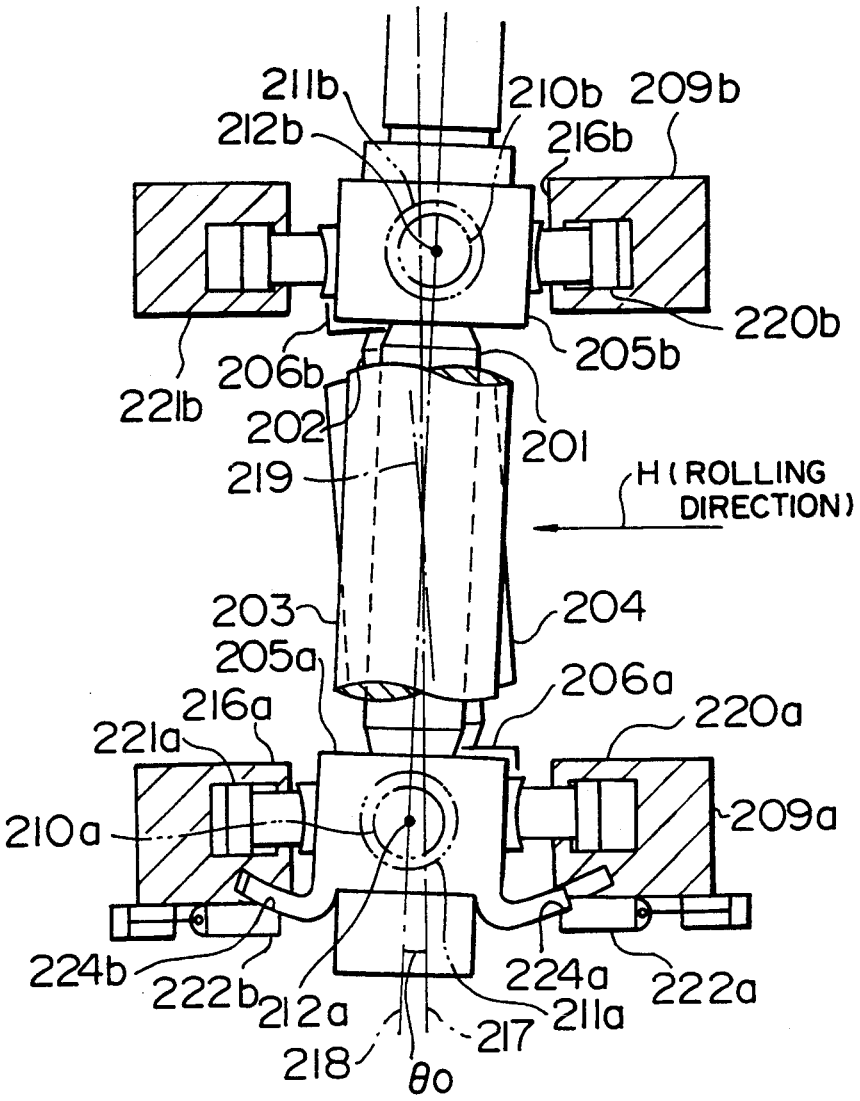
FIG. 16 is a partial sectional view taken along line XVI—XVI in FIG. 15.

In FIGS. 15 and 16, a 4-high cross mill of this embodiment comprises upper and lower work rolls 201, 202, upper and lower back-up rolls 203, 204 for respectively supporting the upper and lower work rolls, upper chocks 205*a*, 205*b* and lower chocks 206*a*, 206*b* provided at both ends of the work rolls for rotatably supporting the work rolls, as well as upper chocks 207*a*, 207*b* and lower chocks 208*a*, 208*b* provided at both ends of the back-up rolls for rotatably supporting the back-up rolls. The upper chocks 205*a*, 205*b* and the lower chocks 206*a*, 206*b* of the work rolls are movably mounted to operation side and drive side housings 209*a*, 209*b*, as described later, to change a respective cross angle of a pair of the upper and lower work rolls 201, 202. On the other hand, the upper chocks 207*a*, 207*b* and the lower chocks 208*a*, 208*b* of the back-up rolls are fixedly mounted to the operation side and drive side housings 209*a*, 209*b* at least during the rolling in successive passes, thereby allowing the cross angle of only the work rolls to be changed. Further, the back-up rolls 203, 204 are arranged such that their axes 218, 219 are inclined at an angle of 1.2° in opposite directions relative to a line 217 perpendicular to the rolling direction H.

In upper portions of the operation side and drive side housings 209*a*, 209*b*, there are respectively provided, as screwdown devices or pass line level adjusters, screwdown screws 210*a*, 210*b* and screwdown nuts 211*a* (the drive side nut being not shown). The screwdown screws 210*a*, 210*b* are arranged such that a straight line connecting their centers 212*a*, 212*b* is inclined at an angle of 1.2° in the same direction as the axis 218 of the upper back-up roll 203 relative to the line 217 perpendicular to the rolling direction H. Operation side and drive side supports 250*a*, 250*b* for respectively supporting the lower chocks 208*a*, 208*b* of the lower back-up roll 204 are likewise arranged such that a straight line connecting the centers 213*a*, 213*b* (see FIG. 17) of their chock supporting surfaces is inclined at an angle of 1.2° in the same direction as the axis 219 of the lower back-up roll 204 relative to the line 217 perpendicular to the rolling direction H. Stated otherwise, the centers 212*a*, 212*b* of the operation side and drive side screwdown screws 210*a*, 210*b* are aligned with the axis 218 of the upper back-up roll 203, while the centers 213*a*, 213*b* of the chock supporting surfaces of the supports 150*a*, 150*b* are aligned with the axis 219 of the lower back-up roll 204.

In the case where additional hydraulic jacks are installed below the lower chocks, though not shown, these hydraulic jacks are also arranged such that a straight line connecting their centers is inclined at an angle of 1.2° in the same direction as the lower back-up roll 204 relative to the line 217 perpendicular to the rolling direction H.

In windows 216*a*, 216*b* of the operation side and drive side housings 209*a*, 209*b*, there are respectively provided two sets of operation side and drive side upper crossing devices which include hydraulic cylinders 220*a*, 221*a* and 220*b*, 221*b* for inclining the upper work roll 201. The angle of an axis of the upper work roll 201 is controlled by driving those upper crossing devices. Likewise, two sets of similar operation side and drive side lower crossing devices (not shown) are provided for the lower work roll 202 so that the angle of an axis of the lower work roll 202 is controlled by driving those lower crossing devices.

Figure 17:
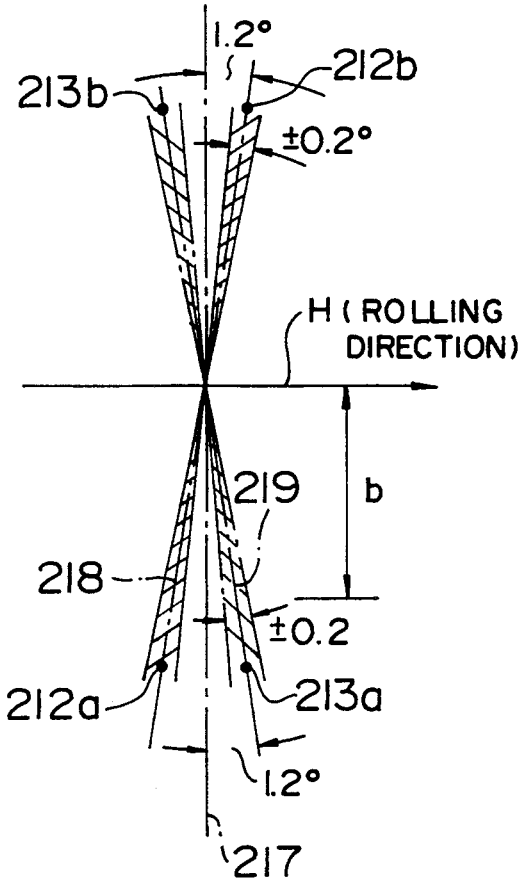
FIG. 17 is an illustration showing a neutral angle of upper and lower work rolls and the control range of a cross angle.

The upper and lower work rolls 201, 202 are inclined by the above-mentioned crossing devices in the range of about ±0.2°, as shown in FIG. 17, in opposite directions about the respective angle of 1.2° relative to the aforesaid perpendicular line 217 for control of a cross angle. More specifically, the angle that the axis of the upper work roll 201 forms relative to the perpendicular line 217 and the angle that the axis of the lower work roll 202 forms relative to the perpendicular line 217 are each defined as a cross angle. Assuming that the cross angle is $\theta$ and the angle corresponding to a neutral position for the cross angle control (i.e., the neutral angle) is $\theta_0$, the cross angle $\theta$ is controlled not in the range of 0 to $\theta_{max}$ as usual in the prior art, but in the range of $\theta_0-\Delta\theta$ to $\theta_0+\Delta\theta$ about the neutral angle $\theta_0$. While the cross angle control may be performed, similarly to the foregoing embodiments, during the time when no strip is passing through the mill, it is possible in this embodiment to conduct the cross angle control during the rolling of strips because the screwdown force of the screwdown device does not directly act on the work roll to be inclined.

The neutral angle $\theta_0$ for the cross angle control is not only the same 1.2° as the angle at which the straight line connecting the centers 212*a*, 212*b* of the operation side and drive side screwdown screws 210*a*, 210*b* is inclined and the angle at which the straight line connecting the centers 213*a*, 213*b* of the chock supporting surfaces of the operation side and drive side supports 150*a*, 150*b* is inclined, but also the same 1.2° as the angle at which the axes 218, 219 of the upper and lower back-up rolls 203, 204 are inclined. As a result, the centers 212*a*, 212*b* of the operation side and drive side screwdown screws 8*a*, 8*b* and the axis 218 of the upper back-up roll 203 are positioned in vertical alignment with the axis of the upper work roll at the neutral position and also aligned with the centers of the upper chocks 205*a*, 205*b*. Likewise, the centers 213*a*, 213*b* of the chock supporting surfaces of the operation side and drive side supports 150*a*, 150*b* and the axis 219 of the lower back-up roll 204 are positioned in vertical alignment with the axis of the lower work roll at the neutral position and also aligned with the centers of the lower chocks 206*a*, 206*b*.

The upper and lower work roll chocks 205*a*, 205*b* are restricted in the axial direction by keeper plates 222*a*, 222*b* and 223*a*, 223*b* which have arc-shaped surfaces 224*a*, 224*b* for allowing the chocks to incline.

When changing the rolls, the upper and lower work rolls 201, 202 are turned so that their angles of inclination become 0°, i.e., that the cross angle relative to the rolling direction becomes zero, and then drawn out of the housings 209*a*, 209*b* for replacement by new ones. Though not shown, the upper and lower work rolls 201, 202 are each driven by a motor through a universal spindle and a reducer similarly to ordinary rolling mills.

Additionally, while the upper chocks 207*a*, 207*b* and the lower chocks 208*a*, 208*b* of the back-up rolls are fixed to the operation side and drive side housings 209*a*, 209*b* during the rolling in successive passes, as mentioned above, hydraulic cylinders may be provided to incline those chocks 207*a*, 207*b* and 208*a*, 208*b* while no strip is passing through the mill. In this case, the back-up rolls 203, 204 can be turned to make the angle of inclination 0° and drawn out of the housings 209*a*, 209*b* for replacement by new ones, when they are to be changed.

Operation of the 4-high rolling mill of this embodiment thus constructed will be described below.

First, in a conventional 4-high work roll cross mill, upper and lower back-up rolls are arranged such that their axes are perpendicular to the rolling direction. Also, the centers of screwdown screws are aligned with the centers of chocks of the back-up rolls.

In the above conventional 4-high work roll cross mill, when the upper and lower work rolls 201, 202 are turned $\theta$ about the center O of respective roll barrels in opposite directions to cross each other, the work rolls 201, 202 are also crossed at an angle of $\theta$ relative to the back-up rolls 203, 204.

On the contrary, in this embodiment, the axes of the back-up rolls 203, 204 are inclined in opposite directions relative to the line perpendicular to the rolling direction, but in the same directions as those in which the work rolls 201, 202 are respectively inclined. This arrangement is basically advantageous in that the angle formed by the axes of the work rolls 201, 202 and the axes of the back-up rolls 203, 204 is always held small and, therefore, wear of the back-up rolls becomes so small as to reduce the frequency of replacement of the back-up rolls. Further, a relative slip between the rolls is small and variations in surface properties and roughness of the work rolls can be suppressed to an insignificant degree.

In the conventional 4-high work roll cross mill, when the upper and lower work rolls 201, 202 are turned $\theta$ about the center O of respective roll barrels in opposite directions to cross each other, a difference in roll-to-roll gap between the roll center O and a point spaced from the roll center O by a distance b in the direction of strip width, i.e., a roll gap $C_b$, is approximately expressed below by referring to FIG. 5 and 6;

$$C_b=(b^2/R)\theta^2(1+\epsilon) \quad \ldots (8)$$

where R is the radius of the work roll and $\epsilon$ is an extent of influence of the gap between the work roll and the back-up roll upon the gap between the upper and lower work rolls under the rolling load. Since $\epsilon$ is usually smaller than 1, the formula (8) becomes equal to the formula (1) in the first embodiment by omitting the term of $\theta$ for simplicity.

Accordingly, a variation $C_{bmax}$ of the roll gap as resulted by changing $\theta$ from zero to $\theta_{max}$ is given by $C_{bmax}=(b^2/R)\theta_{max}^2$.

In this embodiment, the cross angle $\theta$ is controlled not in the range of 0 to $\theta_{max}$ relative to the aforesaid line 217 perpendicular to the rolling direction as usual in the prior art, but in the range of $\theta_0-\Delta\theta$ to $\theta_0+\Delta\theta$ about the neutral angle $\theta_0$ on an assumption that the angle $\theta_0$ at which the axes of the back-up rolls 203, 204 are inclined are defined as a neutral angle.

By so controlling, the formulae (3) to (7) derived before in connection with the first embodiment similarly hold for comparison of the crown control range between the present invention and the prior art, which means that the angle between the back-up roll and the work roll is as small as ¼ to 1/6 of the value in the prior art. Therefore, the axial sliding speed between the back-up rolls 203, 204 and the work rolls 1, 2 is reduced correspondingly, making it possible to further reduce wear of the back-up rolls 203, 204 and hence prolong service life of the back-up rolls. Also, variations in roughness of the work roll surface is suppressed to ¼ to 1/6 of the extent in the prior art, and roughness of the work roll surface is determined by a sliding action with respect to strips to be rolled. In addition, the power loss due to axial sliding between the rolls can also be reduced to ¼ to 1/6 of the value in the prior art.

Further, with such arrangement that the upper work roll 201 is crossed ±0.2° with respect to a reference line given by the axis 218 thereof at the neutral angle and the lower work roll 202 is crossed ±0.2° with respect to a reference line given by the axis 219 thereof at the neutral angle oppositely to the cross direction of the upper work roll, the intersect angle between the work roll and the back-up roll can be reduced from 1° in the prior art down to 1/5, i.e., 0.2°, as shown in FIG. 7, with the result of the above-mentioned advantages. Another advantage is in that while the extent by which strip crown is varied upon control was proportional to the square of the cross angle in the prior art, it is substantially linear, thus making control easier.

Further, with this embodiment, since the intersect angle $2\theta$ between the upper and lower work rolls is always larger than 2°, the transition temperature is not changed and hence the low temperature toughness is improved, as explained before by referring to FIG. 8. In addition, the transition temperature has a constant value without variations, thus ensuring uniform quality.

Still another advantage of this embodiment is that since the cross angle control can be made during the rolling of strips, it is possible to control the strip shape in real time while measuring it.

Seventh Embodiment

Figure 18:
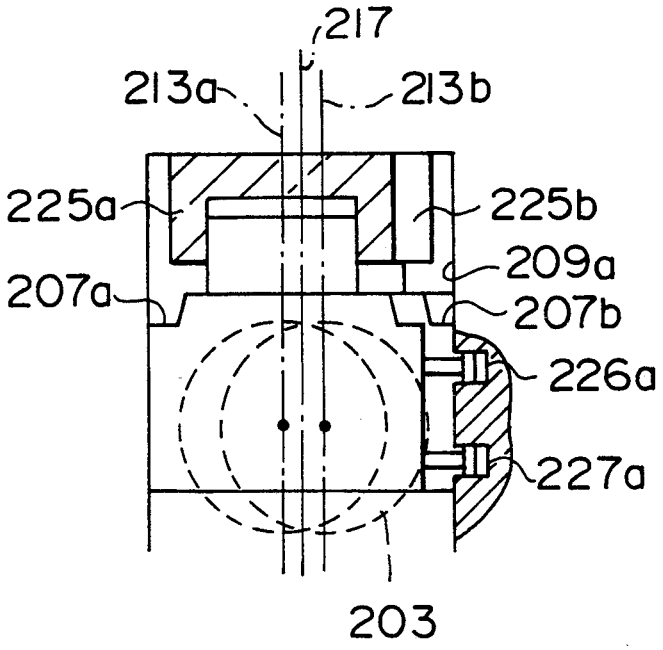
FIG. 18 is a partial sectional view of a screwdown device area of a 4-high rolling mill according to a seventh embodiment of the present invention.

A seventh embodiment of the present invention will be described by referring to FIG. 18. This embodiment represents an arrangement related to a section of the screwdown device and the back-up roll chock.

Recently, screwdown devices of a strip rolling mill have generally been constituted by hydraulic jacks of long stroke in a cold rolling mill. In FIG. 18, an operation side hydraulic jack 225*a* and a drive side hydraulic jack 225*b* are each a hydraulic jack of long stroke. A line connecting the centers of the operation side hydraulic jack 225*a* and the drive side hydraulic jack 225*b* is inclined relative to the line perpendicular to the rolling direction and aligned with the axis of the back-up roll. By so arranging, the similar operating effect to that in the embodiment of FIG. 15 can be obtained. Further, the chock 207*a* of the operation side back-up roll is pushed to the left, as viewed in the figure, by hydraulic cylinders 226, 227 mounted to the operation side housing 209*a*, while the chock 207*b* of the drive side back-up roll is pushed to the right, as viewed in the figure, by hydraulic cylinders (not shown). With such an arrangement, no clearances are generated in the chocks 207*a*, 207*b* and the cross angle can be controlled with high accuracy.

In hot rolling, a hydraulic jack of short stroke is usually combined with a pass line level adjuster of screw type, and the screwdown device may be of such a combination. In this case, too, a line connecting the centers of such screwdown devices is inclined relative to the line perpendicular to the rolling direction and aligned with the axis of the back-up roll. The similar operating effect is also thereby obtained.

Eighth Embodiment

An eighth embodiment of the present invention will be described by referring to FIG. 19. This embodiment represents one example of arrangement of a rolling mill system.

Figure 19:
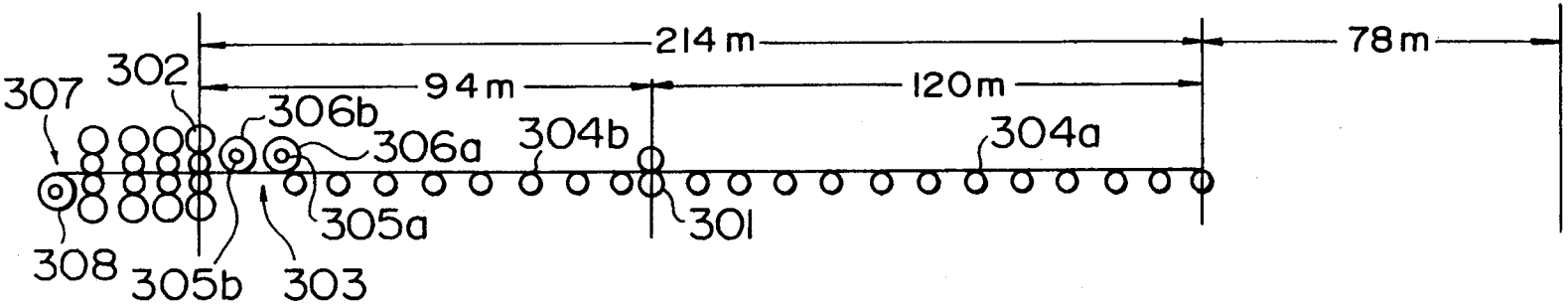
FIG. 19 is an illustration of entire layout of a metal strip hot rolling mill system according to an eighth embodiment of the present invention.

In FIG. 19, a hot strip mill system of this embodiment comprises one reversible 2-high rough rolling mill 301, a train of finish rolling mills 302 comprising four stands, and a non-expansible drum type winding/unwinding device 303 disposed between the rough rolling mill 301 and the train of finish rolling mills 302. The rough rolling mill 301 is formed by the 2-high rolling mill of the first embodiment shown in FIG. 1. The four stands constituting the train of finish rolling mills 302 are each any one of the 4-high rolling mill of the third embodiment shown in FIG. 12, the 4-high rolling mill of the fourth embodiment shown in FIG. 13, the 4-high rolling mill of the fifth embodiment shown in FIG. 14, and the 4-high rolling mill of the sixth embodiment shown in FIG. 15.

After being heated to about 500° C. in a heating furnace (not shown), a slab extracted from the furnace is transported over table rollers 304*a* and reversibly rolled by the 2-high rough rolling mill 301 into a rough bar with a thickness of about 20 to 40 mm. The rough bar after the final pass is transported over the table rollers 304*b* and once wound into a coil 306*a* by a winding drum 305*a* of the winding/unwinding device 303. After completion of the winding, the drum 305*a* and the coil 306*a* are moved to an unwinding position where they now serve as an unwinding drum 305*b* and an unwinding coil 306*b*, respectively. Then, the rough bar is let out of the unwinding coil 306*b*, finish-rolled by the train of finish rolling mills 302, and wound into a product coil 308 by a winder 307.

The table length on the entry side of the rough rolling mill 301 is set to 120 m which corresponds to the bar length one pass before the final rough rolling pass, and the distance between the rough rolling mill 301 and the train of finish rolling mills 302 is set to 94 m which resulted by adding 84 m corresponding to the bar length two passes before the final rough rolling pass and the length of 10 m required for installment of the winding-/unwinding device 303. Thus, the distance between the rough rolling mill 301 and the train of finish rolling mills 302 is set to be less than the bar length after the final rough rolling pass.

A rough rolling mill in the form of a 2-high mill is suitable for rolling a thick slab from the standpoint of biting, because the work mill diameter of the 2-high mill is greater than that of a 4-high mill. In the 2-high mill, however, deflection of the work rolls is largely varied depending on the rolling load with no provision of back-up rolls. In the case of rolling aluminum strips, change in the rolling load depending on materials is so large that the roll crown must be changed for each of materials.

Since the 2-high rolling mill in this embodiment adopts the 2-high rolling mill shown in FIG. 1, the strip crown control can easily be performed by changing the cross angle of the work rolls. Consequently, even when the rolling load varies to a large extent as encountered in rolling aluminum strips, quality in the rolling can be improved with a sufficient capability of the strip crown control.

Since the four stands constituting the train of finish rolling mills 302 in this embodiment adopt each the 4-high rolling mill of any one of the foregoing embodiments which can linearly change the extent by which strip crown is controlled, the strip crown control is easily performed in the finish rolling with the result of improved rolling quality. In the case of adopting the 4-high rolling mill of the sixth embodiment shown in FIG. 15, since the intersect angle between the work roll and the back-up roll becomes smaller and surface properties of the work roll are kept from deterioration, a further improvement in the rolling quality is expected. Also, in the case of adopting the 4-high rolling mill of the sixth embodiment shown in FIG. 15, since the cross angle control can be made during the rolling of strips, it is possible to control the strip shape in real time while measuring it, which presents another advantage of improving a shape control function.

Further, in this embodiment, the rough bar after the final pass is once wound into a coil by the winding/unwinding device 303. Therefore, the rough bar finally extending between the rough rolling mill and the train of finish rolling mills is a bar two passes before the final rough rolling pass and its length is only 84 m as mentioned above. On a condition that the winding/unwinding device requires a length of 10 m, the pass length between the rough rolling mill and the train of finish rolling mills is 94 m. In the prior art equipped with no winding/-unwinding device, the pass length between the rough rolling mill and the train of finish rolling mills was on the order of 172 m which corresponds to the bar length after the final pass. Thus, this embodiment enables a reduction of 78 m in the pass length between the rough rolling mill and the train of finish rolling mills.

With the winding/unwinding device 303 being of the non-expansible drum type, still other advantages are obtained in that the rough bar can be tightly wound up, flaws can be prevented from generating due to sliding between the bars, and the rolling quality can be further improved.

It should be noted that while this embodiment employs the 2-high rolling mill of the first embodiment shown in FIG. 1 for the reversible rough rolling mill 301, the latter mill may be any one of the 4-high rolling mill of the third embodiment shown in FIG. 12, the 4-high rolling mill of the fourth embodiment shown in FIG. 13, the 4-high rolling mill of the fifth embodiment shown in FIG. 14, and the 4-high rolling mill of the sixth embodiment shown in FIG. 15. Such a modification can also provide the similar operating effect to that in this embodiment.

Ninth Embodiment

A ninth embodiment of the present invention will be described by referring to FIG. 20. This embodiment represents another example of arrangement of a rolling mill system.

Figure 20:
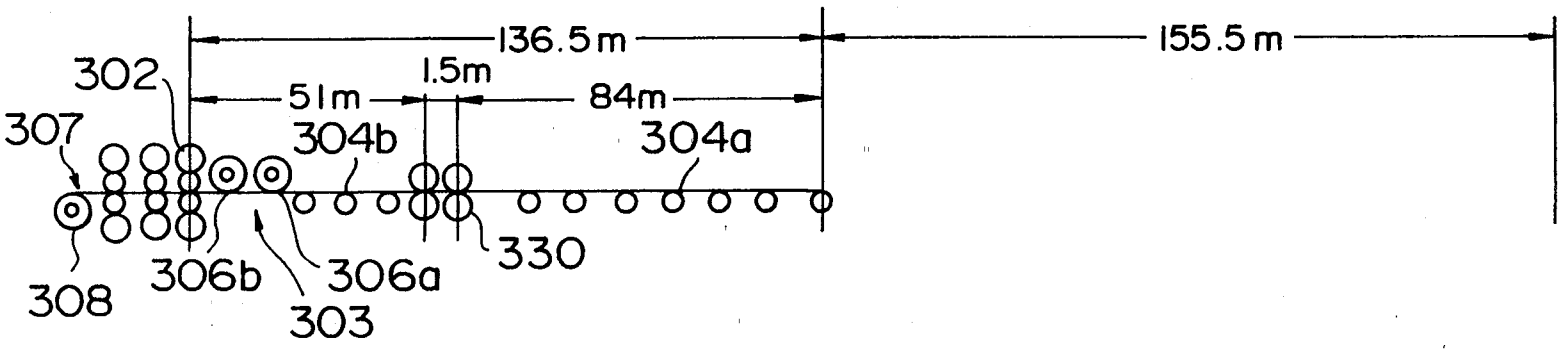
FIG. 20 is an illustration of entire layout of a metal strip hot rolling mill system according to a ninth embodiment of the present invention.

In FIG. 20, an aluminum strip mill system of this embodiment is different from the embodiment of FIG. 19 in that an integral type reversible 2-high rough rolling mill 330 including two stands of 2-high rolling mills is installed instead of the single reversible 2-high rough rolling mill. The rough rolling mill 330 is of the cross type 2-high twin mill of the second embodiment shown in FIG. 9. The remaining construction is the same as the eighth embodiment except that the entire system length is still more reduced by adopting the 2-high twin mill 330.

This embodiment thus arranged is to further develop the advantages of the above-stated eighth embodiment.

More specifically, in this embodiment adopting the 2-high twin mill 330, two stands of 2-high rolling mills are disposed adjacent each other. Assuming that the two stands of 2-high rolling mills have the same screw-down rate of 30%, the bar length on the entry side of the 2-high twin mill 330 becomes 84 m which corresponds to 70% of 120 m resulted in the case of employing a single rough rolling mill, and the bar length on the exit side of the 2-high twin mill 330 is much reduced to 41 m (from multiplication of 84 m by $0.7\times0.7=0.49$) in comparison with 84 m resulted in the case of employing a single rough rolling mill. However, if the rough rolling mill comprises two stands of 4-high mills simply disposed in adjacent relation, the rough rolling mill is increased in the cost and requires additional length of approximately 6 m between the two stands of 4-high mills.

For the purpose of improving such a drawback, this embodiment employs the integral type 2-high twin mill as mentioned above. Adopting the twin mill makes it possible to keep down an increase in the cost and reduce the distance between the two stands of 2-high mills to approximately 1.5 m. Further, since the two stands of rough mills are able to double a production capability, the bar thickness can be still more thinner and the number of stands required for finish mills is reduced. Thinner bars are disadvantageous in that the temperature is lowered and the cost is raised due to the shorter roller pitch for the table. However, the former disadvantage can be avoided by winding the bar into a coil. The latter disadvantage does not affect the actual cost, because the bar thickness is even not so thin as that in the prior art on the entry side of the rough rolling mill where the long table is required, and the bar thickness becomes small on the exit side of the rough rolling mill, but the table length required is very short there.

Additionally, since the 2-high twin mill 330 in this embodiment comprises two sets of rolls crossed each other together, the strip crown control can easily be performed. by changing the cross angle of the work rolls. As a result, even when the rolling load varies to a large extent as encountered in rolling aluminum strips, quality in the rolling can be improved with a sufficient capability of the strip crown control.

SUMMARY OF ADVANTAGES

According to the present invention, the following advantages are obtained.

(1) It is possible to perform a large extent of strip crown control with a smaller cross deviation than usual in the prior art, eliminate the need of an equalizer beam, and achieve a smaller-sized rolling mill with simple construction.

(2) The effect resulted from cross rolling upon the metallurgical structure of strips to be rolled can be kept uniform.

(3) The extent by which strip crown is varied upon control becomes substantially linear rather than being proportional to the square of the cross angle, which is effective in making control easier.

(4) The drawback of a 2-high twin mill, i.e., an insufficient capability of crown control, can be solved by the simple twin cross type construction. Particularly when used as a rough stand, there can be resulted great advantages such as a reduction in the system length, a saving in total energy, and a saving in thermal energy due to prevention of a temperature drop of strips.

(5) In a 4-high work roll cross mill in which the cross angle of only work rolls is changed to perform the strip crown control, the angle formed between the work rolls and back-up rolls is smaller than that in the prior art. Therefore, wear of the back-up rolls becomes small and the frequency of replacement of the back-up rolls is reduced.

(6) Also, since the angle formed between the work rolls and back-up rolls is smaller than that in the prior art, a relative slip between the work rolls and the back-up rolls is small and change in surface properties and roughness of the work rolls are suppressed to an insignificant degree. It is thus possible to keep down variations in quality of the strip surface and prevent the occurrence of a rolling slip.

(7) Further, the power loss due to axial sliding between the rolls can be reduced.

(8) In a rolling mill system which adopts the rolling mill of the present invention for a rough rolling mill, the strip crown control can easily be performed by changing the cross angle of the work rolls. Consequently, even when the rolling load varies to a large extent as encountered in rolling aluminum strips, quality in the rolling can be improved with a sufficient capability of the strip crown control. In the case of adopting the 2-high twin mill, the crown control capability is further enhanced to effect the rolling with higher quality.

(9) In a rolling mill system which adopts the rolling mill of the present invention for a train of finish rolling mills, the strip crown control can easily be performed in the finish rolling and hence the rolling quality can be improved. In the case of adopting a 4-high rolling mill of the work roll cross type, since the intersect angle between the work roll and the back-up roll becomes smaller and surface properties of the work roll are kept from deterioration, a further improvement in the rolling quality is expected. Also, since the cross angle control can be made during the rolling of strips, it is possible to control the strip shape in real time while measuring it, and provide a high shape control function.

What is claimed is:

1. A rolling mill comprising:

upper and lower work rolls defining a gap therebetween for passage of strip material being rolled while traveling in a rolling direction in a rolling plane, said work rolls having a drive side which is rotably driven and is located at one side of the gap and an operation side at an opposite side of the gap, an operation side force-applying device and a drive side force-applying device for applying forces to at least one of the work rolls in a direction toward the gap, said operation side force-applying device and drive side force-applying device having respective centers of operation connected by a straight line which is inclined at a positive angle with respect to a line extending perpendicular to the rolling direction and parallel to the rolling plane, and work roll aligning devices for controlling strip crown of the strip material being rolled by changing a cross angle of said upper and lower work rolls with respect to one another, said straight line connecting respective centers of operation of the force-applying devices being inclined with respect to the line extending perpendicular to the rolling direction and parallel to the rolling plane in the same direction as one of said work rolls.

2. A rolling mill according to claim 1, wherein said straight line connecting respective centers of operation of the force-applying devices is parallel to one of said work rolls when said one work roll is in a neutral cross angle position.

3. A rolling mill according to claim 2, comprising cross-angle adjusting drive devices for adjustably inclining said upper and lower work rolls crossed with respect to one another in opposite directions about a neutral vertical plane which includes the straight line connecting respective centers of operation of the force applying devices.

4. A rolling mill according to claim 1, wherein said rolling mill is a 2-high rolling mill.

5. A rolling mill according to claim 4, comprising cross-angle adjusting drive devices for adjustably inclining said upper and lower work rolls crossed with respect to one another in opposite directions about a neutral vertical plane which includes the straight line connecting respective centers of operation of the force applying devices.

6. A rolling mill according to claim 4, wherein said force applying devices each include a screwdown device.

7. A rolling mill according to claim 4, wherein said force applying devices each include a hydraulic jack.

8. A rolling mill according to claim 1, wherein said rolling mill is a 4-high rolling mill comprising upper and lower back-up rolls, and wherein said force-applying devices are disposed to apply forces directly on at least one of said back-up rolls.

9. A rolling mill according to claim 8, wherein said straight line connecting respective centers of operation of the force-applying devices is parallel to one of said work rolls when said one work roll is in a neutral cross angle position.

10. A rolling mill according to claim 8, wherein said upper and lower back-up rolls are also crossed with respect to each other for accommodating strip crown control.

11. A rolling mill according to claim 10, wherein said upper and lower back-up rolls are each inclined in the same direction as corresponding ones of said upper and lower work rolls relative to the line extending perpendicular to the rolling direction and parallel to the rolling plane.

12. A rolling mill according to claim 11, wherein said straight line connecting respective centers of operation of the force-applying devices is parallel to said one back-up roll acted on by the force-applying devices when said one back-up roll is in a neutral cross angle position.

13. A rolling mill according to claim 11, comprising cross-angle adjusting drive devices for adjustably inclining said upper and lower work rolls crossed with respect to one another in opposite directions about a neutral vertical plane which includes the straight line connecting respective centers of operation of the force applying devices.

14. A rolling mill according to claim 8, wherein said straight line connecting respective centers of operation of the force-applying devices is parallel to said one back-up roll acted on by the force-applying devices when said one back-up roll is in a neutral cross angle position.

15. A rolling mill according to claim 14, comprising cross-angle adjusting drive devices for adjustably inclining said upper and lower work rolls crossed with respect to one another in opposite directions about a neutral vertical plane which includes the straight line connecting respective centers of operation of the force applying devices.

16. A rolling mill according to claim 8, comprising cross-angle adjusting drive devices for adjustably inclining said upper and lower work rolls crossed with respect to one another in opposite directions about a neutral vertical plane which includes the straight line connecting respective centers of operation of the force applying devices.

17. A rolling mill according to claim 8, wherein said force applying devices each include a screwdown device.

18. A rolling mill according to claim 8, wherein said force applying devices each include a hydraulic jack.

19. A rolling mill according to claim 1, comprising cross-angle adjusting drive devices for adjustably inclining said upper and lower work rolls crossed with respect to one another in opposite directions about a neutral vertical plane which includes the straight line connecting respective centers of operation of the force applying devices.

20. A rolling mill according to claim 1, wherein said force applying devices each include a screwdown device.

21. A rolling mill according to claim 1, wherein said force applying devices each include a hydraulic jack.

22. A rolling mill comprising:

upper and lower work rolls defining a gap therebetween for passage of strip material being rolled while traveling in a rolling direction in a rolling plane, said work rolls having a drive side which is rotably driven and is located at one side of the gap and an operation side at an opposite side of the gap, upper and lower back-up rolls contacting the respective upper and lower work rolls to force them toward the gap, an operation side force-applying device and a drive side force-applying device for applying forces to at least one of the back-up rolls in a direction toward the gap, said operation side force-applying device and drive side force-applying device having respective centers of operation connected by a straight line which is inclined at a positive angle with respect to a line extending perpendicular to the rolling direction and parallel to the rolling plane, and back-up roll aligning devices for controlling the strip crown of strip material being rolled by changing a cross angle of said upper and lower back-up rolls with respect to one another, said straight line connecting respective centers of operation of the force-applying devices being inclined with respect to the line extending perpendicular to the rolling direction and parallel to the rolling plane in the same direction as one of said back-up rolls.

23. A rolling mill according to claim 22, wherein said upper and lower work rolls extend parallel to the line extending perpendicular to the rolling direction and parallel to the rolling plant.

24. A rolling mill according to claim 23, wherein the back-up rolls are crossed with respect to one another.

25. A 2-high rolling mill for rolling material in a rolling direction in a rolling plane comprising one mill housing, first upper and lower work rolls and second upper and lower work rolls assembled in said mill housing to build up two sets of 2-high cross mills, first drive means for inclining said first and second upper work rolls together, and second drive means for inclining said first and second lower work rolls together, whereby a cross angle of said first and second upper work rolls and a cross angle of said first and second lower work rolls are simultaneously changed by said first and second drive means to perform strip crown control.

26. A 2-high rolling mill according to claim 25, further comprising a first operation side screwdown device and a first drive side screwdown device for applying a screwdown force to at least one of said first upper and lower work rolls, and a second operation side screwdown device and a second drive side screwdown device for applying a screwdown force to at least one of said second upper and lower work rolls, wherein said first operation side screwdown device and said first drive side screwdown device are arranged such that a straight line connecting a center of said first operation side screwdown device and a center of said first drive side screwdown device is inclined at a positive angle relative to a line perpendicular to the rolling direction and parallel to the rolling plane in a similar direction as said work roll to which said screwdown force is applied by said first operation side screwdown device and said first drive side screwdown device, and said second operation side screwdown device and said second drive side screwdown device are arranged such that a straight line connecting a center of said second operation side screwdown device and a center of said second drive side screwdown device is inclined at a positive angle relative to a line perpendicular to the rolling direction and parallel to the rolling plane in a similar direction as said work roll to which said screwdown force is applied by said second operation side screwdown device and said second drive side screwdown device.

27. A 2-high rolling mill according to claim 26, wherein said first and second upper and lower rolls have neutral positions for changing said cross angles, respectively, in a vertical plane which includes a straight line connecting the center of said first operation side screwdown device and the center of said first drive side screwdown device and in a vertical plane which includes the straight line connecting the center of said second operation side screwdown device and the center of said second drive side screwdown device.

28. A 2-high rolling mill according to claim 26, wherein said first and second drive means incline said first upper and lower work rolls and said second upper and lower work rolls in opposite directions, respectively, about a respective vertical plane which includes the straight line connecting the center of said first operation side screwdown device and the center of said first drive side screwdown device and about a respective vertical plane which includes the straight line connecting the center of said second operation side screwdown device and the center of said second drive side screwdown device.

29. A 2-high rolling mill according to claim 25 or 26, further comprising a first upper operation side chock and a first upper drive side chock for supporting said first upper work roll, a first lower operation side chock and a first lower drive side chock for supporting said first lower work roll, a second upper operation side chock and a second upper drive side chock for supporting said second upper work roll, and a second lower operation side chock and a second lower drive side chock for supporting said second lower work roll, wherein said first upper operation side chock and said first lower operation side chock, said first upper drive side chock and said first lower drive side chock, said second upper operation side chock and said second lower operation side chock, and said second upper drive side chock and said second lower drive side chock are arranged to be contacted with each other in pair.

30. A hot rolling mill system including at least one reversible rough rolling mill and a train of finish rolling mills, wherein said at least one reversible rough rolling mill comprises:

upper and lower work rolls defining a gap therebetween for passage of strip material being rolled while traveling in a rolling direction in a rolling plane, said work rolls having a drive side which is rotably driven and is located at one side of the gap and an operation side at an opposite side of the gap, an operation side force-applying device and a drive side force-applying device for applying forces to at least one of the work rolls in a direction toward the gap, said operation side force-applying device and drive side force-applying device having respective centers of operation connected by a straight line which is inclined at a positive angle with respect to a line extending perpendicular to the rolling direction and parallel to the rolling plane, and work roll aligning devices for controlling the strip crown of strip material being rolled by changing a cross angle of said upper and lower work rolls with respect to one another, said straight line connecting respective centers of operation of the force-applying devices being inclined with respect to the line extending perpendicular to the rolling direction and parallel to the rolling plane in the same direction as one of said work rolls.

31. A hot rolling mill system according to claim 30, wherein said straight line connecting respective centers of operation of the force-applying devices is parallel to one of said work rolls when said work roll is in a neutral cross angle position.

32. A hot rolling mill system according to claim 30, wherein said train of finish rolling mills includes at least one finish rolling mill comprising:

upper and lower work rolls defining a gap therebetween for passage of strip material being rolled while traveling in a rolling direction and parallel to the rolling plane, said work rolls having a drive side which is rotably driven and is located at one side of the gap and an operation side at an opposite side of the gap, an operation side force-applying device and a drive side force-applying device for applying forces to at least one of the work rolls in a direction toward the gap, said operation side force-applying device and drive side force-applying device having respective centers of operation connected by a straight line which is inclined at a positive angle with respect to a line extending perpendicular to the rolling direction and parallel to the rolling plane, and work roll aligning devices for controlling the strip crown of strip material being rolled by changing a cross angle of said upper and lower work rolls with respect to one another, said straight line connecting respective centers of operation of the force-applying devices being inclined with respect to the line extending perpendicular to the rolling direction and parallel to the rolling plane in the same direction as one of said work rolls, wherein said finish rolling mill is a 4-high rolling mill comprising upper and lower back-up rolls, and wherein said force applying devices are disposed to apply forces directly on at least one of said back-up rolls.

33. A hot rolling mill system according to claim 32, wherein said upper and lower back-up rolls are also crossed with respect to each other for accommodating strip crown control.

34. A hot rolling mill system including at least one reversible rough rolling mill and a train of finish rolling mills, wherein said train of finish rolling mills includes at least one finish rolling mill comprising:

upper and lower work rolls defining a gap therebetween for passage of strip material being rolled while traveling in a rolling direction in a rolling plane, said work rolls having a drive side which is rotably driven and is located at one side of the gap and an operation side at an opposite side of the gap, upper and lower back-up rolls contacting the respective upper and lower work rolls to force them toward the gap, an operation side force-applying device and a drive side force-applying device for applying forces to at least one of the back-up rolls in a direction toward the gap, said operation side force-applying device and drive side force-applying device having respective centers of operation connected by a straight line which is inclined at a positive angle with respect to a line extending perpendicular to the rolling direction and parallel to the rolling plane, and back-up roll aligning devices for controlling the strip crown of strip material being rolled by changing a cross angle of said upper and lower back-up rolls with respect to one another, said straight line connecting respective centers of operation of the force-applying devices being inclined with respect to the line extending perpendicular to the rolling direction and parallel to the rolling plane in the same direction as one of said back-up rolls.

35. A hot rolling mill system according to claim 34, wherein said upper and lower work rolls extend parallel to the line extending perpendicular to the rolling direction and parallel to the rolling plane.

36. A hot rolling mill system according to claim 35, wherein the back-up rolls are crossed with respect to one another.

37. A hot rolling mill system according to claim 34, wherein said at least one reversible rough rolling mill is a 2-high rolling mill comprising one mill housing, first upper and lower work rolls and second upper and lower work rolls assembled in said mill housing to build up two sets of 2-high cross mills, first drive means for inclining said first and second upper work rolls together, and second drive means for inclining said first and second lower work rolls together, whereby a cross angle of said first and second upper work rolls and a cross angle of said first and second lower work rolls are simultaneously changed by said first and second drive means to perform strip crown control.

38. A hot rolling mill system including at least one reversible rough rolling mill and a train of finish rolling mills, wherein said at least one reversible rough rolling mill is a 2-high rolling mill comprising one mill housing, first upper and lower work rolls and second upper and lower work rolls assembled in said mill housing to build up two sets of 2-high cross miles, first drive means for inclining said first and second upper work rolls together, and second drive means for inclining said first and second lower work rolls together, whereby a cross angle of said first and second upper work rolls and a cross angle of said first and second lower work rolls are simultaneously changed by said first and second drive means to perform strip crown control.

39. A hot rolling mill system according to claim 38, wherein said train of finish rolling mills includes at least one finish rolling mill comprising:

upper and lower work rolls defining a gap therebetween for passage of strip material being rolled while traveling in a rolling direction in a rolling plane, said work rolls having a drive side which is rotably driven and is located at one side of the gap and an operation side at an opposite side of the gap, an operation side force-applying device and a drive side force-applying device for applying forces to at least one of the work rolls in a direction toward the gap, said operation side force-applying device and drive side force-applying device having respective centers of operation connected by a straight line which is inclined at a positive angle with respect to a line extending perpendicular to the rolling direction and parallel to the rolling plane, and work roll aligning devices for controlling the strip crown of strip material being rolled by changing a cross angle of said upper and lower work rolls with respect to one another, said straight line connecting respective centers of operation of the force-applying devices being inclined with respect to the line extending perpendicular to the rolling direction and parallel to the rolling plane in the same direction as one of said work rolls, wherein said finish rolling mill is a 4-high rolling mill comprising upper and lower back-up rolls, and wherein said force applying devices are disposed to apply forces directly on at least one of said back-up rolls.

40. A hot rolling mill system according to claim 39, wherein said upper and lower back-up rolls are also crossed with respect to each other for accommodating strip crown control.

41. A method of manufacturing strip material using a rolling mill comprising:

upper and lower work rolls defining a gap therebetween for passage of strip material being rolled while traveling in a rolling direction in a rolling plane, said work rolls having a drive side which is rotably driven and is located at one side of the gap and an operation side at an opposite side of the gap, an operation side force-applying device and a drive side force-applying device for applying forces to at least one of the work rolls in a direction toward the gap, said operation side force-applying device and drive side force-applying device having respective centers of operation connected by a straight line which is inclined at a positive angle with respect to a line extending perpendicular to the rolling direction and parallel to the rolling plane, and work roll aligning devices for controlling the strip crown of strip material being rolled by changing a cross angle of said upper and lower work rolls with respect to one another, said straight line connecting respective centers of operation of the force-applying devices being inclined with respect to the line extending perpendicular to the rolling direction and parallel to the rolling plane in the same direction as one of said work rolls, wherein said method comprises controlling said cross angle in opposite plus and minus directions about a neutral position set in a vertical plane which includes said straight line connecting the centers of operation of the force applying devices.

42. A method according to claim 41, wherein said rolling mill is a 2-high mill.

43. A method according to claim 41, wherein said rolling mill is a 4-high mill comprising upper and lower back-up rolls associated with the respective upper and lower work rolls, said method comprising applying said force applying devices to at least one of said back-up rolls.

44. A rolling method of using a 4-high rolling mill for rolling material in a rolling direction in a rolling plane comprising upper and lower work rolls defining a gap therebetween, upper and lower back-up rolls, and an operation side force applying device and a drive side force applying device for applying a force to at least one of said upper and lower back-up rolls in a direction toward the gap, at least said upper and lower back-up rolls being crossed with respect to each other; and changing a cross angle of said upper and lower back-up rolls to thereby perform strip crown control, wherein the method comprises:

arranging said operation side force applying device and said drive side force applying device such that a straight line connecting a center of force applied by said operation side force applying device and a center of force applied by said drive side force applying device is inclined at a positive angle in the same direction as said back-up roll to which said force is applied, relative to a line perpendicular to the rolling direction and parallel to the rolling plane; and controlling said cross angle in opposite plus and minus directions about a neutral position set in a vertical plane which includes said straight ling connecting the centers of force applied by the force applying devices.

45. A rolling method of using a 4-high rolling mill for rolling material in a rolling direction in a rolling plane comprising upper and lower work rolls, upper and lower back-up rolls defining a gap therebetween, and an operation side force applying device and a drive side force applying device for applying a force to at least one of said upper and lower back-up rolls in a direction toward the gap, said upper and lower work rolls being crossed relative to said upper and lower back-up rolls and also crossed with respect to each other; and changing a cross angle of said upper and lower work rolls to thereby perform strip crown control, wherein the method comprises:

arranging said upper and lower back-up rolls such that axes of said upper and lower back-up rolls are each inclined at a positive angle in a same direction as corresponding ones of said upper and lower work rolls relative to a line perpendicular to a rolling direction and parallel to the rolling plane;

arranging said operation side force applying device and said drive side force applying device such that a straight line connecting the center of force applied by said operation side force applying device and the center of force applied by said drive side force applying device is inclined at a positive angle in the same direction and at the same angle as said back-up roll to which said force is applied, relative to the line perpendicular to the rolling direction and parallel to the rolling plane; and controlling said cross angle in opposite plus and minus directions about a neutral position set in a vertical plane which includes said straight line connecting the centers of force applied by the force applying devices.

46. A rolling method according to claim 44 or 45, wherein control of said cross angle is made during a time when no strip is passing through said mill.

47. A rolling method according to claim 45, wherein control of said cross angle is made during rolling when a strip is passing through said mill.

48. A rolling method according to claim 44 or 45, wherein said cross angle is made zero relative to the line perpendicular to the rolling direction, when changing said rolls.

49. A rolling method of using a 2-high rolling mill for rolling in a rolling direction in a rolling plane comprising one mill housing, first upper and lower work rolls defining a first gap and second upper and lower work rolls defining a second gap assembled in said mill housing to build up two sets of 2-high cross mills, first drive means for inclining said first and second upper work rolls together, second drive means for inclining said first and second lower work rolls together, a first operation side force applying device and a first drive side force applying device for applying a force to at least one of said first upper and lower work rolls in a direction toward the first gap, and a second operation side force applying device and a second drive side force applying device for applying a force to at least one of said second upper and lower work rolls in a direction toward the second gap; and simultaneously changing a cross angle of said first and second upper work rolls and a cross angle of said first and second lower work rolls by said first and second drive means to perform strip crown control, wherein the method comprises:

arranging said first operation side force applying device and said first drive side force applying device such that a straight line connecting a center of force applied by said first operation side force applying device and a center of force applied by said first drive side force applying device is inclined at a positive angle relative to a first line perpendicular to the rolling direction and parallel to the rolling plane in the same direction as said work roll to which said force is applied by said first operation side force applying device and said first drive side force applying device;

arranging said second operation side force applying device and said second drive side force applying device such that a straight line connecting a center of force applied by said second drive side force applying device is inclined at a positive angle relative to a second line perpendicular to the rolling direction and parallel to the rolling plane in the same direction as said work roll to which said force is applied by said second operation side force applying device and said second drive side force applying device; and controlling said cross angles in opposite plus and minus directions about a neutral position set in vertical planes which include respectively, said first and second straight lines for each of said first upper and lower work rolls and said second upper and lower work rolls in pairs.

50. A rolling method according to claim 49, wherein control of said cross angles is made during a time when no strip is passing through said mill.

51. A rolling method according to claim 49, wherein said cross angle is made zero relative to the first and second lines perpendicular to the rolling direction and parallel to the rolling plane, when changing said rolls.

* * * * *